US011238808B2

(12) United States Patent
Lee et al.

(10) Patent No.: US 11,238,808 B2
(45) Date of Patent: Feb. 1, 2022

(54) DISPLAY DEVICE ADJUSTING A SCAN PULSE

(71) Applicant: Samsung Display Co., Ltd., Yongin-si (KR)

(72) Inventors: Donggyu Lee, Suwon-si (KR); Ah Reum Kim, Hwaseong-si (KR); Wontae Kim, Hwaseong-si (KR); SeokYoung Yoon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/831,320

(22) Filed: Mar. 26, 2020

(65) Prior Publication Data

US 2021/0035504 A1 Feb. 4, 2021

(30) Foreign Application Priority Data

Aug. 2, 2019 (KR) ..... 10-2019-0094246

(51) Int. Cl.

| | |
|---|---|
| ***G09G 3/30*** | (2006.01) |
| ***G09G 3/3266*** | (2016.01) |
| ***G09G 3/3291*** | (2016.01) |
| ***G09G 3/36*** | (2006.01) |

(52) U.S. Cl.

CPC ..... *G09G 3/3266* (2013.01); *G09G 3/3291* (2013.01); *G09G 3/3674* (2013.01); *G09G 2360/16* (2013.01)

(58) Field of Classification Search

CPC ... G09G 3/3674; G09G 3/3677; G09G 3/3266

See application file for complete search history.

(56) References Cited

U.S. PATENT DOCUMENTS

| | | | | |
|---|---|---|---|---|
| 2005/0195671 | A1* | 9/2005 | Taguchi | G02F 1/13306 365/203 |
| 2014/0313181 | A1* | 10/2014 | Hong | G09G 3/2003 345/212 |
| 2015/0103081 | A1* | 4/2015 | Bae | G06T 1/20 345/501 |
| 2016/0063960 | A1* | 3/2016 | Pyun | G09G 3/3648 345/213 |
| 2018/0158431 | A1* | 6/2018 | Fujikawa | G09G 3/3614 |
| 2019/0027109 | A1* | 1/2019 | Lee | G09G 3/3688 |
| 2019/0295488 | A1* | 9/2019 | Guo | G09G 3/3688 |

FOREIGN PATENT DOCUMENTS

| | | |
|---|---|---|
| KR | 10-1354432 B1 | 1/2014 |
| KR | 10-2018-0127152 A | 11/2018 |

* cited by examiner

*Primary Examiner* — Roy P Rabindranath

(74) *Attorney, Agent, or Firm* — Lewis Roca Rothgerber Christie LLP

(57) ABSTRACT

A display device includes a display panel including a plurality of pixel rows, and a panel driver configured to drive the display panel. The panel driver includes a scan on time decider configured to receive line image data for each of the plurality of pixel rows, and to determine a scan on time change amount for each of the plurality of pixel rows based on the line image data, and a scan control block configured to adjust a scan pulse applied to each of the plurality of pixel rows according to the scan on time change amount.

20 Claims, 19 Drawing Sheets

260a

| | |
|---|---|
| RGV1 | SOTCA1 |
| RGV2 | SOTCA2 |
| RGV3 | SOTCA3 |
| RGV4 | SOTCA4 |
| RGV5 | SOTCA5 |
| RGV6 | SOTCA6 |
| RGV7 | SOTCA7 |
| RGV8 | SOTCA8 |

DISPLAY DEVICE ADJUSTING A SCAN PULSE

CROSS-REFERENCE TO RELATED APPLICATION

This application claims priority to and the benefit of Korean Patent Application No. 10-2019-0094246, filed on Aug. 2, 2019 in the Korean Intellectual Property Office (KIPO), the entire content of which is incorporated herein in its entirety by reference.

BACKGROUND

1. Field

Exemplary embodiments of the present inventive concept relate to a display device, and more particularly to a display device adjusting a scan pulse.

2. Description of the Related Art

A display device, such as an organic light emitting diode (OLED) display device, includes a plurality of pixels coupled to a plurality of scan lines and a plurality of data lines. Each pixel may receive a scan pulse through the scan line during a scan on time (SOT) (or a gate on time), and may store a data voltage received through the data line during the SOT.

In a case where low luminance line data (e.g., black line data) are provided with respect to pixels in the same row, or the pixels coupled to the same scan line, high data voltages corresponding to the low luminance line data may be applied to the pixels, a load of the scan line may be increased by the high data voltages, and thus the SOT for the pixels may be decreased by the increased load.

Further, as a distance from a data driver to each row of the pixels increases, a transition time during which the data voltage reaches a desired voltage level may be increased by a resistor-capacitor (RC) delay. Thus, the SOT during which the data voltages are stored in the pixels in the same row may be reduced according to the increase of the distance from the data driver.

Accordingly, a plurality of pixel rows included in a display panel may have different SOTs, and thus luminance uniformity of the display device may be reduced.

SUMMARY

Some example embodiments provide a display device where a plurality of pixel rows included in a display panel has substantially the same effective scan on time (SOT).

According to example embodiments, there is provided a display device including a display panel including a plurality of pixel rows, and a panel driver configured to drive the display panel. The panel driver includes a scan on time decider configured to receive line image data for each of the plurality of pixel rows, and to determine a scan on time change amount for each of the plurality of pixel rows based on the line image data, and a scan control block configured to adjust a scan pulse applied to each of the plurality of pixel rows according to the scan on time change amount.

In example embodiments, the scan on time decider may include a representative gray value calculation block configured to calculate a representative gray value of the line image data for each of the plurality of pixel rows, and a scan on time change amount decision block configured to determine the scan on time change amount for each of the plurality of pixel rows according to the representative gray value of the line image data.

In example embodiments, the representative gray value calculation block may calculate the representative gray value of the line image data by determining an average of a plurality of pixel gray values represented by the line image data.

In example embodiments, the representative gray value calculation block may be configured to generate a histogram of the line image data by grouping a plurality of pixel gray values represented by the line image data into a plurality of pixel gray groups, and to determine the representative gray value of the line image data based on the histogram of the line image data.

In example embodiments, the scan on time change amount decision block may increase the scan on time change amount as the representative gray value of the line image data decreases.

In example embodiments, the scan on time decider may further include a lookup table configured to store the scan on time change amount corresponding to the representative gray value of the line image data. The scan on time change amount decision block may determine the scan on time change amount for each of the plurality of pixel rows by reading the scan on time change amount corresponding to the representative gray value calculated by the representative gray value calculation block from the lookup table.

In example embodiments, as the scan on time change amount increases (or based on an increase of the scan on time change amount), the scan control block may increase an amplitude of the scan pulse by adjusting at least one of a first gate voltage or a second gate voltage lower than the first gate voltage.

In example embodiments, the panel driver may further include a scan voltage generator configured to generate the first gate voltage and the second gate voltage, and a scan driver configured to apply the scan pulse to each of the plurality of pixel rows based on the first gate voltage and the second gate voltage received from the scan voltage generator. The scan control block may output a voltage level control signal representing an adjusted voltage level of the first gate voltage or the second gate voltage in response to the scan on time change amount, the scan voltage generator may adjust the first gate voltage or the second gate voltage to the adjusted voltage level represented by the voltage level control signal, and the scan driver may output the scan pulse having the adjusted amplitude based on the first gate voltage or the second gate voltage having the adjusted voltage level.

In example embodiments, as the scan on time change amount increases (or based on an increase of the scan on time change amount), the scan control block may increase a width of the scan pulse, or advances a timing of the scan pulse.

In example embodiments, the panel driver may further include a scan voltage generator configured to generate a first clock signal and a second clock signal based on a scan clock signal, and a scan driver configured to apply the scan pulse to each of the plurality of pixel rows based on the first clock signal and the second clock signal received from the scan voltage generator. The scan control block may output the scan clock signal of which a width or a timing is adjusted in response to the scan on time change amount, the scan voltage generator may generate the first clock signal and the second clock signal of which widths or timings are adjusted based on the scan clock signal having the adjusted width or the adjusted timing, and the scan driver may output the scan pulse having the adjusted width or the adjusted timing based on the first clock signal and the second clock signal having the adjusted widths or the adjusted timings.

According to example embodiments, there is provided a display device including a display panel including a plurality of pixel rows, and a panel driver configured to drive the display panel. The panel driver includes a data driver configured to provide data voltages to each of the plurality of pixel rows, a horizontal time decider configured to determine a horizontal time for each of the plurality of pixel rows according to a distance from the data driver to each of the plurality of pixel rows, and a scan control block configured to adjust a scan pulse applied to each of the plurality of pixel rows according to the determined horizontal time.

In example embodiments, the horizontal time decider may gradually increase the horizontal time for each of the plurality of pixel rows according to the distance from the data driver to each of the plurality of pixel rows increases.

In example embodiments, the horizontal time decider may be configured to determine the horizontal time for a middle pixel row from among the plurality of pixel rows as a reference horizontal time, to determine the horizontal time for a near pixel row spaced by a first interval apart from the middle pixel row in a first direction toward the data driver from among the plurality of pixel rows as a horizontal time change amount subtracted from the reference horizontal time, and to determine the horizontal time for a far pixel row spaced by the first interval apart from the middle pixel row in a second direction opposite to the first direction from among the plurality of pixel rows as the horizontal time change amount added to the reference horizontal time.

In example embodiments, the horizontal time decider may include a line memory configured to store line image data for each of the plurality of pixel rows, a horizontal time decision block configured to determine the horizontal time for each of the plurality of pixel rows according to the distance from the data driver to each of the plurality of pixel rows, and a data output block configured to output the line image data stored in the line memory within the determined horizontal time.

In example embodiments, the data output block may be configured to generate a data enable signal representing that the line image data are output to the data driver, and to increase a width of an active period of the data enable signal as the determined horizontal time increases. For example, the data output block is further configured to generate a data enable signal in response to the line image data being outputted from the data driver, and to increase a width of an active period of the data enable signal corresponding to an increase of the determined horizontal time.

In example embodiments, the scan control block may increase a width of the scan pulse as the determined horizontal time increases. For example, the scan control block is further configured to increase a width of the scan pulse corresponding to an increase of the determined horizontal time.

According to example embodiments, there is provided a display device including a display panel including a plurality of pixel rows, and a panel driver configured to drive the display panel. The panel driver includes a timing decider configured to determine a scan on time for each of the plurality of pixel rows based on at least one of line image data for each of the plurality of pixel rows and a distance from a data driver to each of the plurality of pixel rows, and a scan control block configured to adjust a scan pulse applied to each of the plurality of pixel rows according to the determined scan on time.

In example embodiments, the timing decider may include a scan on time decider configured to determine a scan on time change amount, and to determine the scan on time by adding the scan on time change amount to a reference scan on time. The scan on time decider may determine the scan on time change amount for each of the plurality of pixel rows according to a representative gray value of the line image data for each of the plurality of pixel rows.

In example embodiments, the timing decider may include a horizontal time decider configured to determine a horizontal time for each of the plurality of pixel rows, and to determine the scan on time according to the determined horizontal time. The horizontal time decider may determine the horizontal time for each of the plurality of pixel rows according to the distance from the data driver to each of the plurality of pixel rows.

In example embodiments, the timing decider may include a horizontal time decider configured to determine a horizontal time for each of the plurality of pixel rows according to the distance from the data driver to each of the plurality of pixel rows, and to determine an intermediate scan on time according to the determined horizontal time, and a scan on time decider configured to determine a scan on time change amount for each of the plurality of pixel rows according to a representative gray value of the line image data for each of the plurality of pixel rows, and to determine the scan on time by adding the scan on time change amount to the intermediate scan on time.

As described above, a display device according to example embodiments may determine a scan on time change amount for each pixel row based on line image data for the pixel row, and may adjust a scan pulse applied to the pixel row according to the scan on time change amount. Accordingly, in the display device according to example embodiments, a plurality of pixel rows included in a display panel may have substantially the same effective scan on time.

Further, a display device according to example embodiments may determine a horizontal time for each pixel row according to a distance from a data driver to the pixel row, and may adjust a scan pulse applied to the pixel row according to the horizontal time. Accordingly, in the display device according to example embodiments, a plurality of pixel rows included in a display panel may have substantially the same effective scan on time.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
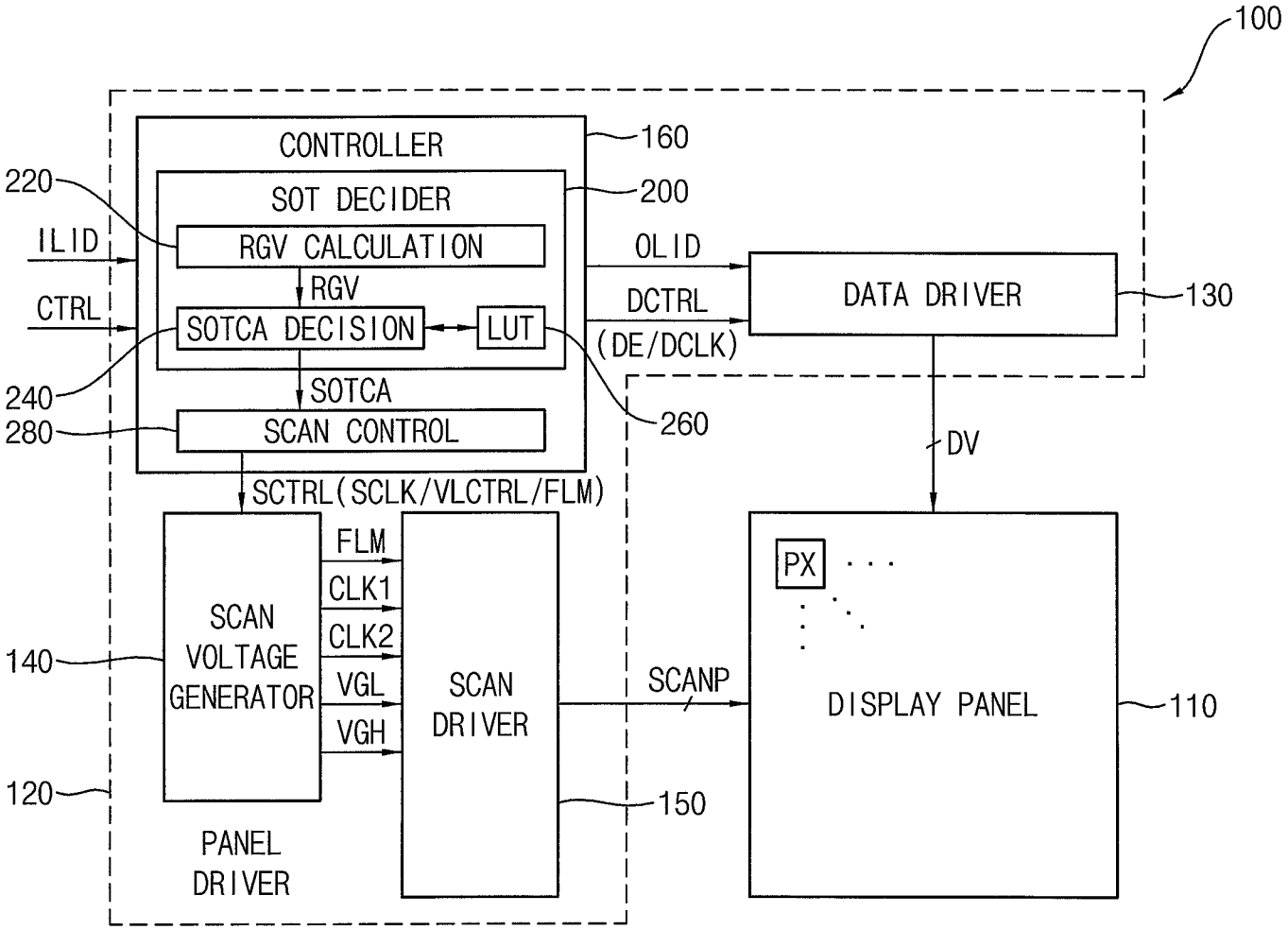
FIG. 1 is a block diagram illustrating a display device, according to some example embodiments of the present disclosure.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Hereinafter, embodiments of the present inventive concept will be explained in detail with reference to the accompanying drawings.

Figure 2:
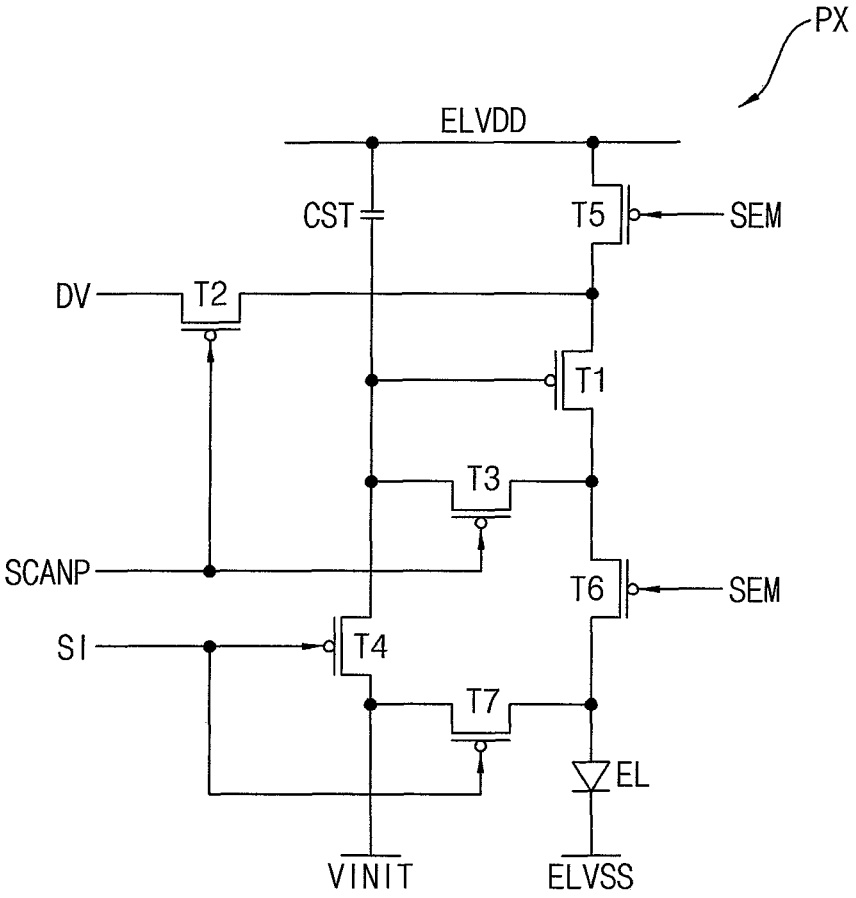
FIG. 2 is a circuit diagram illustrating an example of a pixel included in a display device, according to some example embodiments of the present disclosure.
Figure 3:
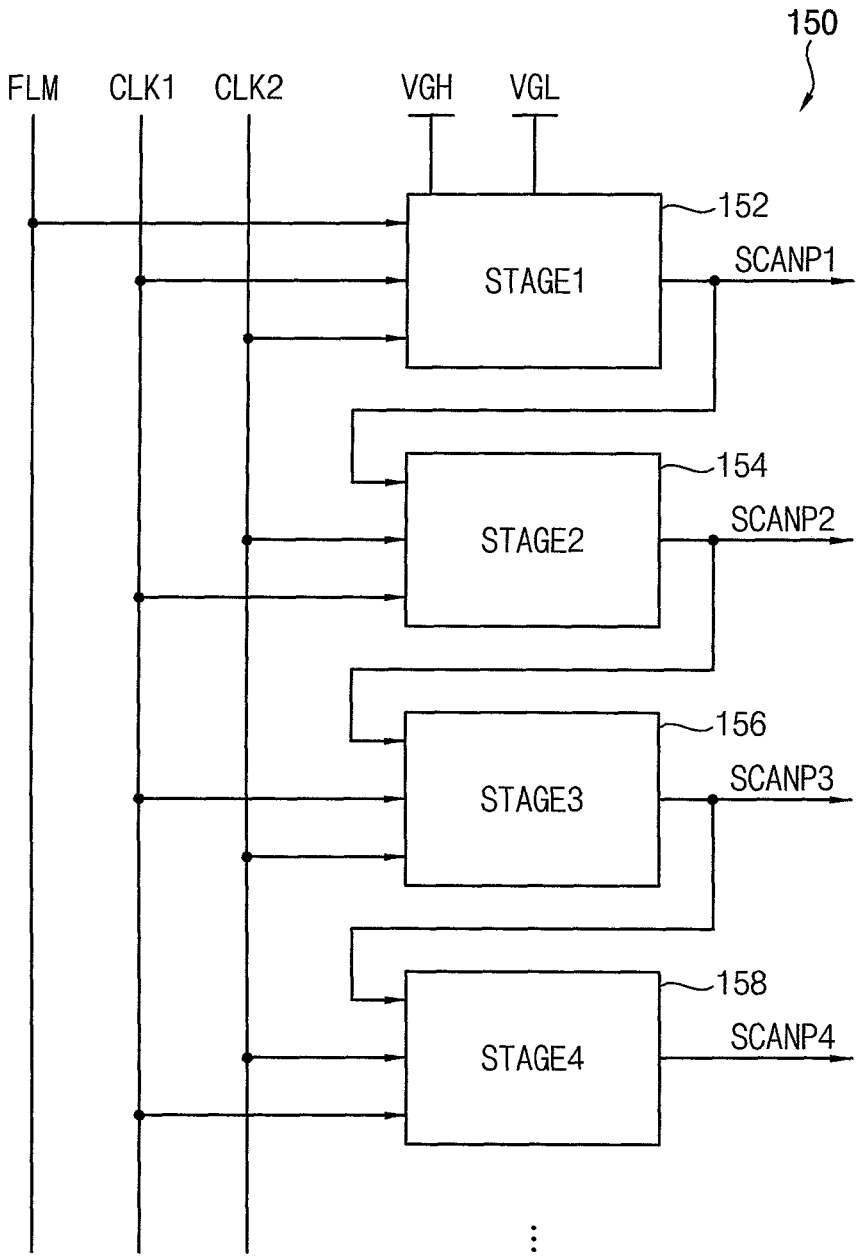
FIG. 3 is a block diagram illustrating an example of a scan driver included in a display device, according to some example embodiments of the present disclosure.
Figure 4:
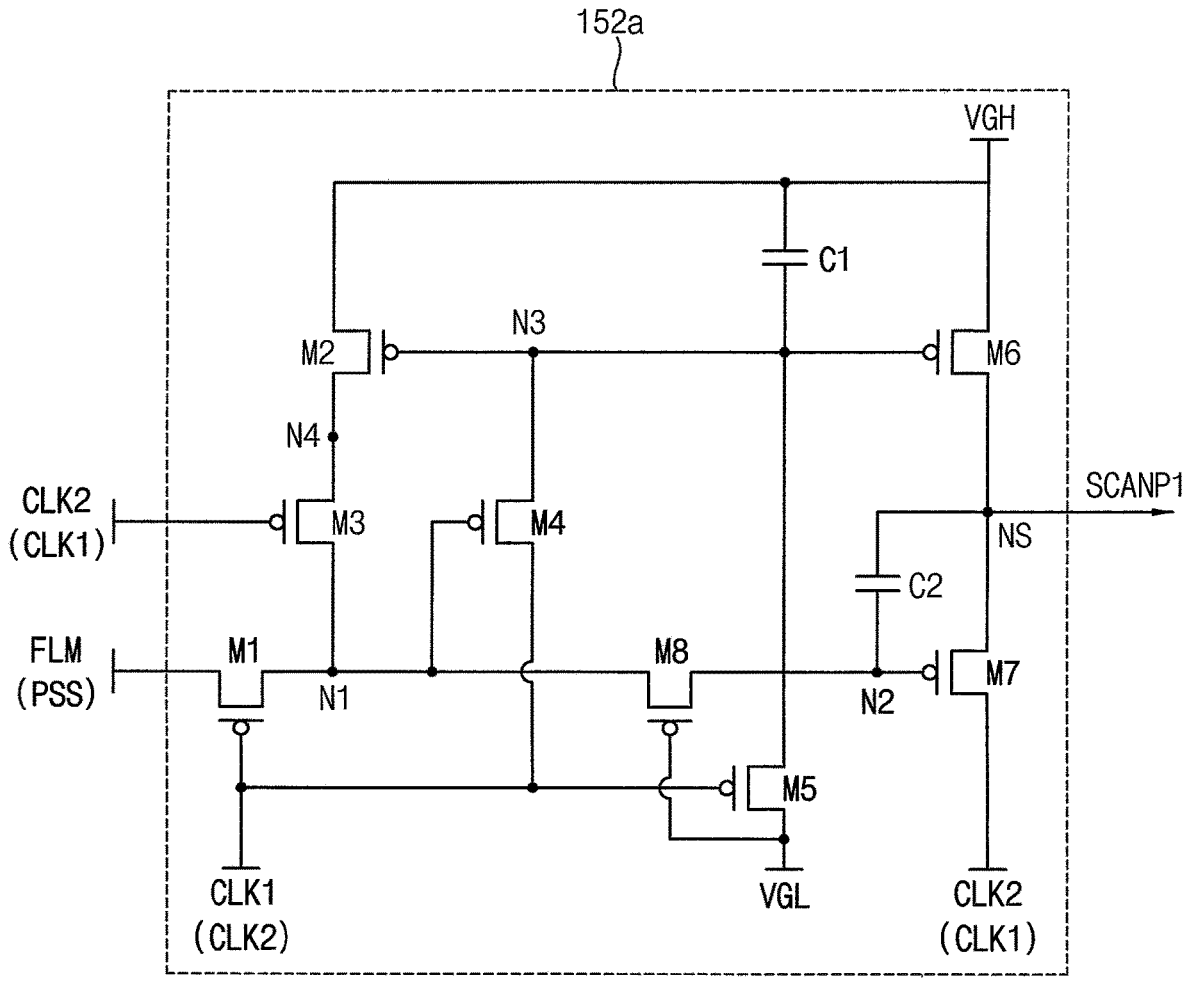
FIG. 4 is a circuit diagram illustrating an example of each stage included in a scan driver of FIG. 3, according to some example embodiments of the present disclosure.
Figure 5:
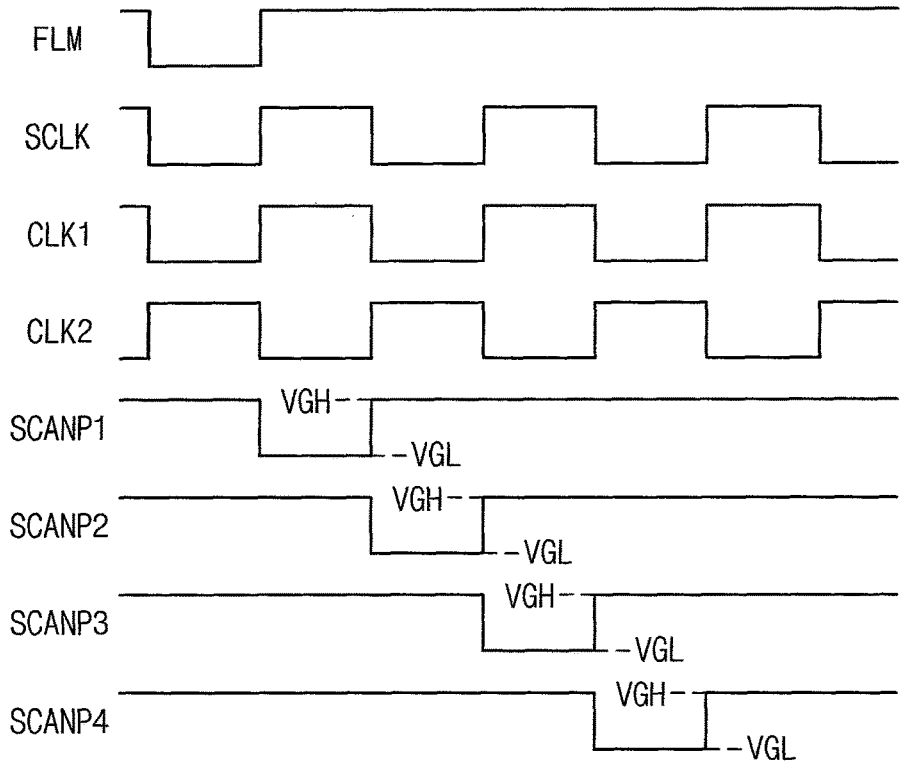
FIG. 5 is a timing diagram for describing an example of an operation of a scan driver of FIG. 3, according to some example embodiments of the present disclosure.
Figure 6:
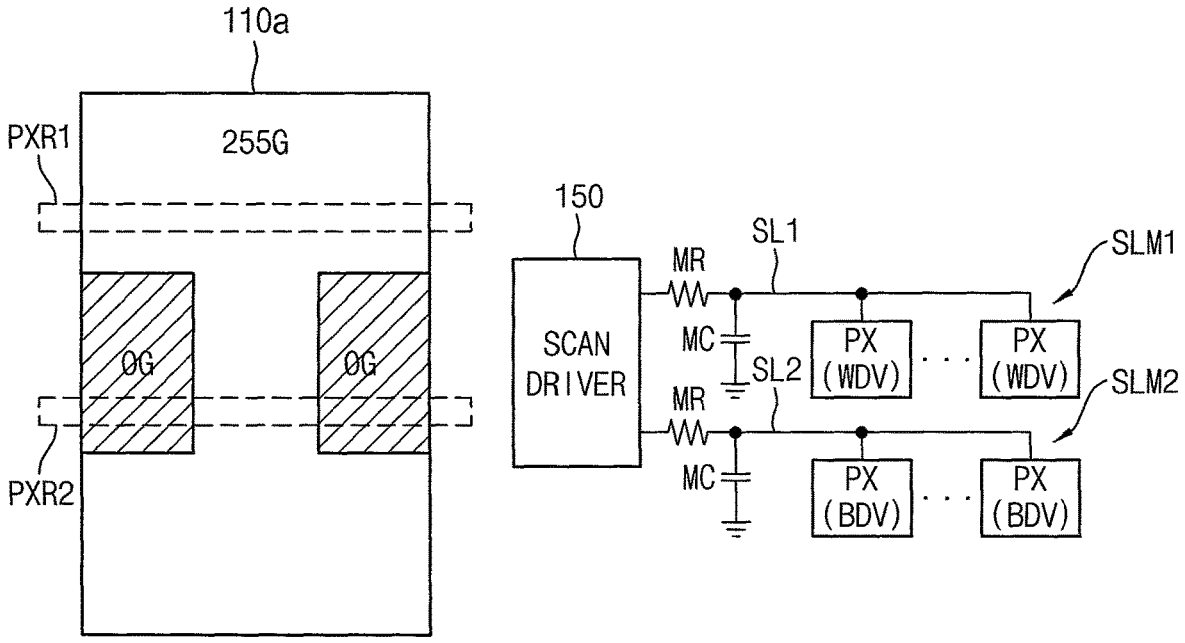
FIG. 6 is a diagram for describing an example of loads of first and second scan lines according to first and second line image data for first and second pixel rows in a display device, according to some example embodiments of the present disclosure.
Figure 7:
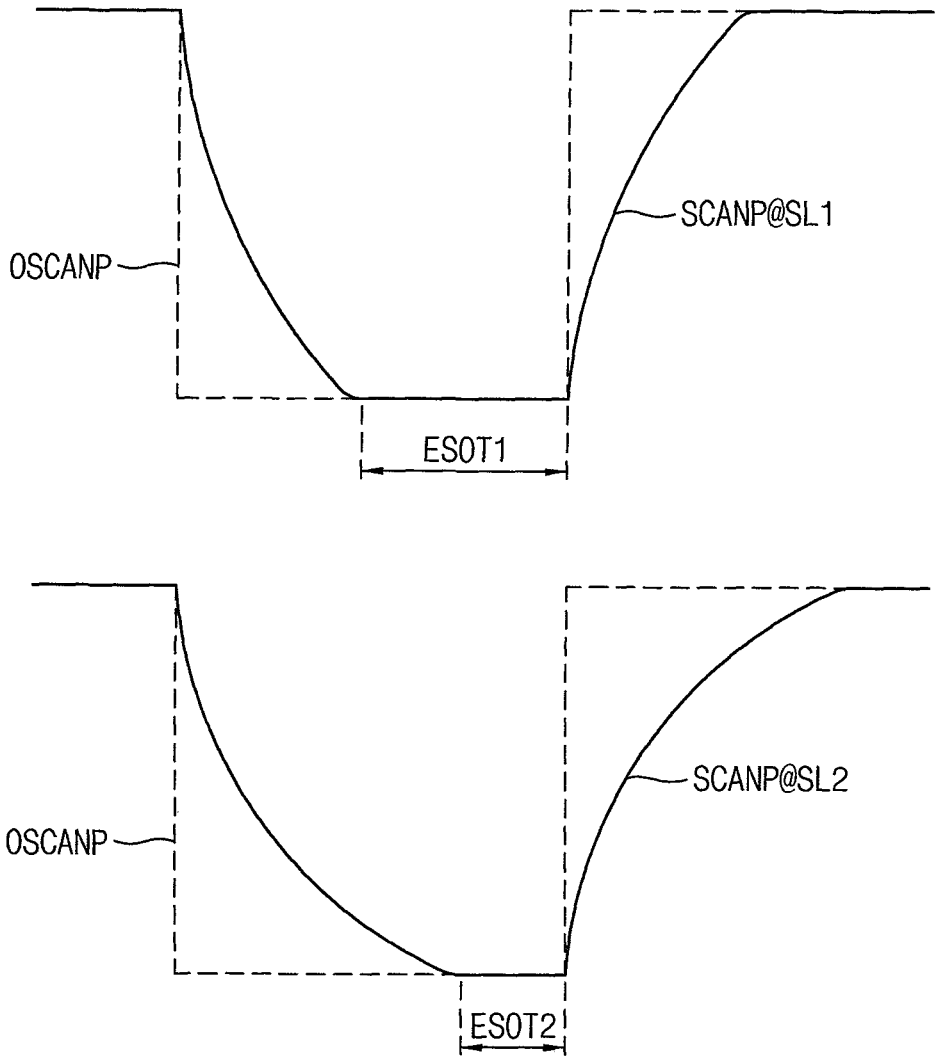
FIG. 7 is a diagram illustrating an example of effective scan on times for first and second pixel rows illustrated in FIG. 6, according to some example embodiments of the present disclosure.
Figure 8:
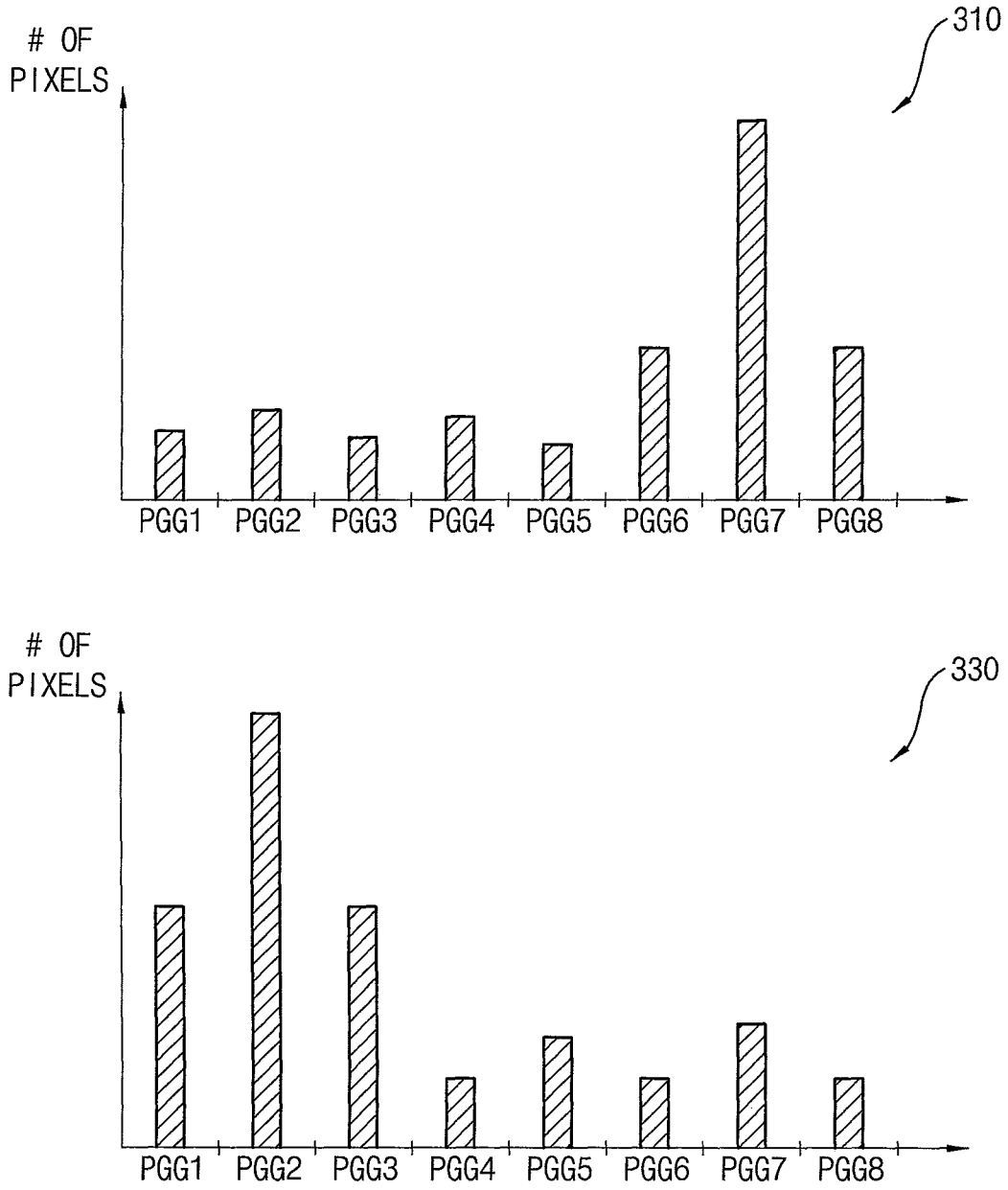
FIG. 8 is a diagram illustrating examples of histograms of line image data generated by a representative gray value calculation block included in a display device of FIG. 1, according to some example embodiments of the present disclosure.
Figures 9, 10:
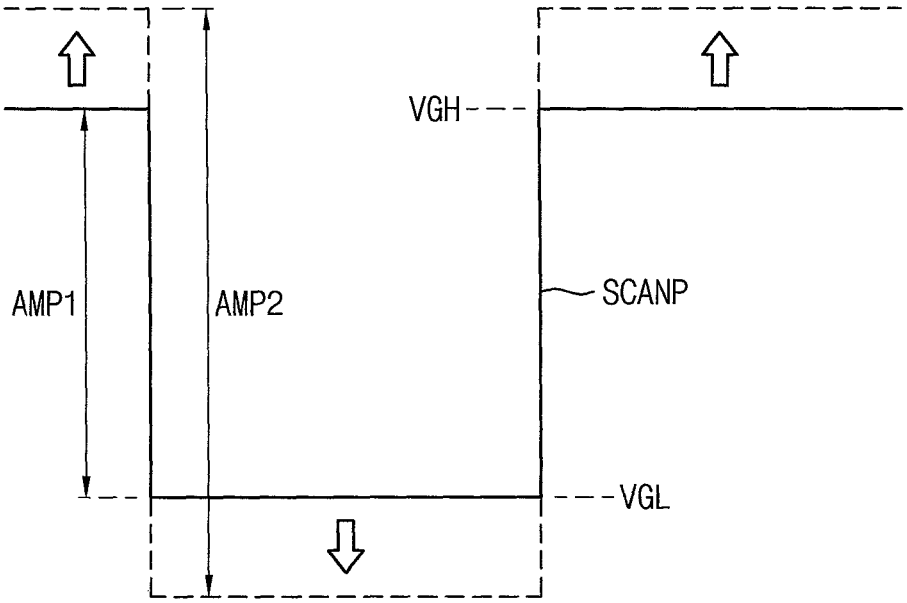
FIG. 9 is a diagram illustrating an example of a lookup table included in a display device of FIG. 1, according to some example embodiments of the present disclosure.
FIG. 10 is a diagram illustrating an example of a scan pulse of which amplitude is adjusted by a scan control block included in a display device of FIG. 1, according to some example embodiments of the present disclosure.
Figure 11:
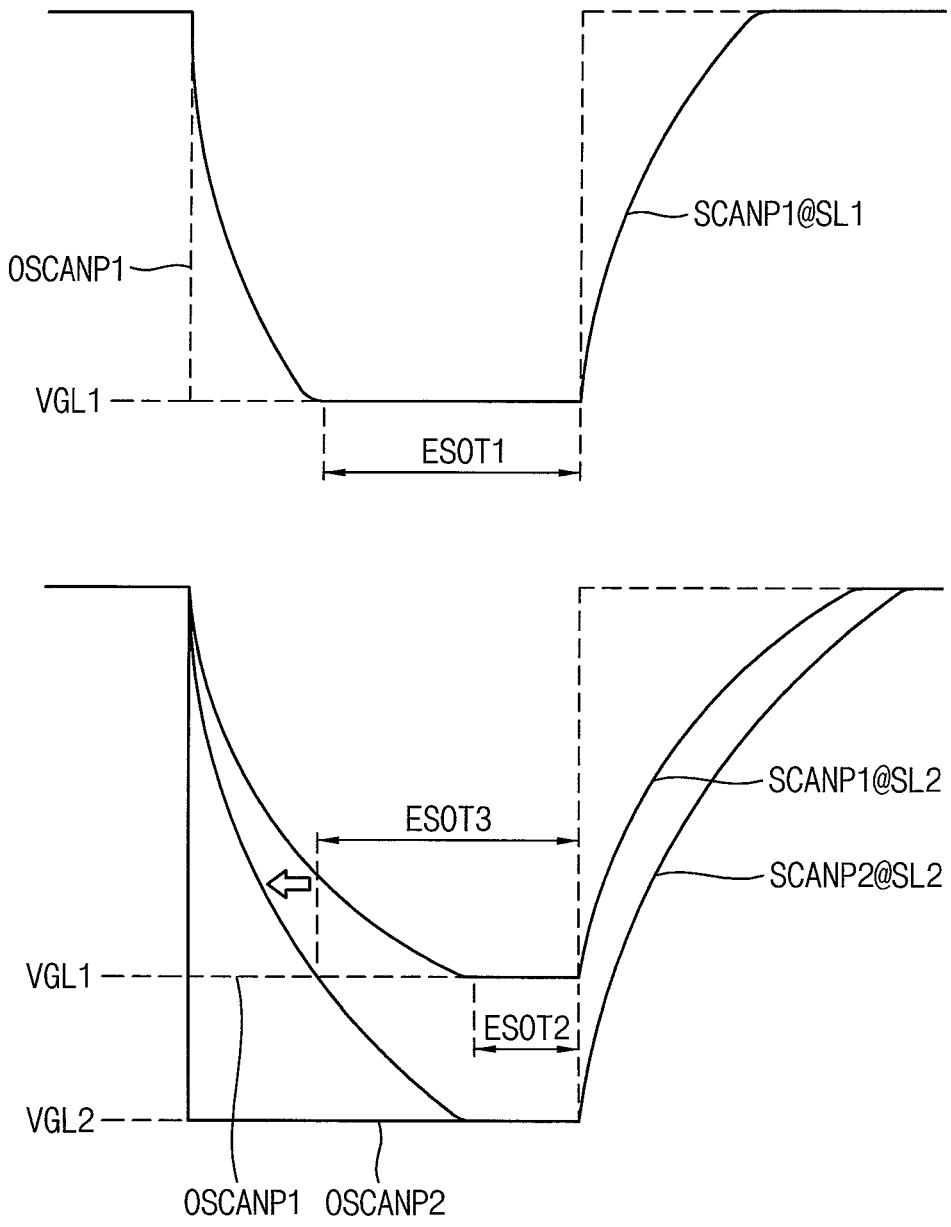
FIG. 11 is a diagram illustrating an example of effective scan on times for first and second pixel rows illustrated in FIG. 6 in an example embodiment where a scan pulse having adjusted amplitude is applied to the second pixel row.
Figure 12:
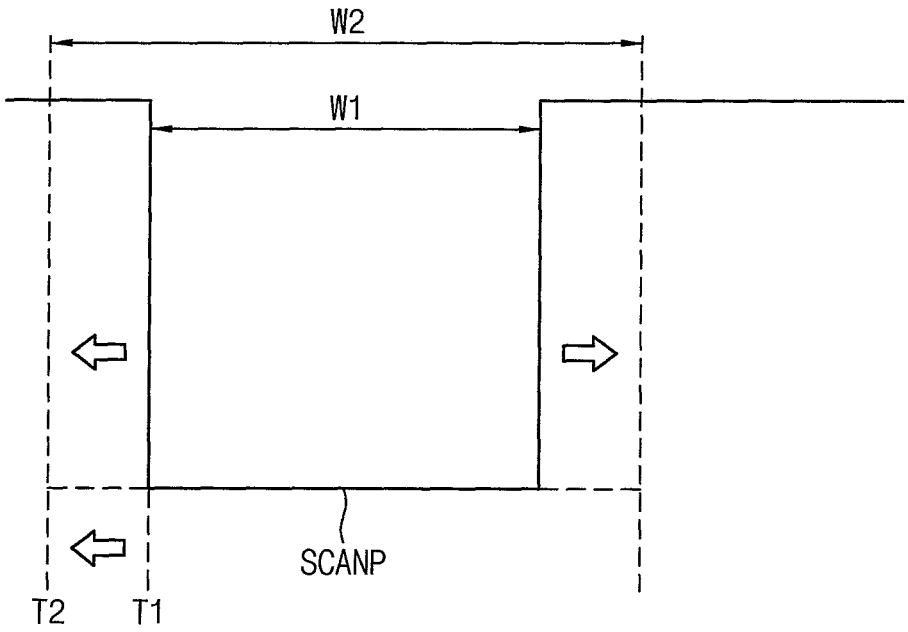
FIG. 12 is a diagram illustrating an example of a scan pulse of which a width and timing are adjusted by a scan control block included in a display device of FIG. 1, according to some example embodiments of the present disclosure.
Figure 13:
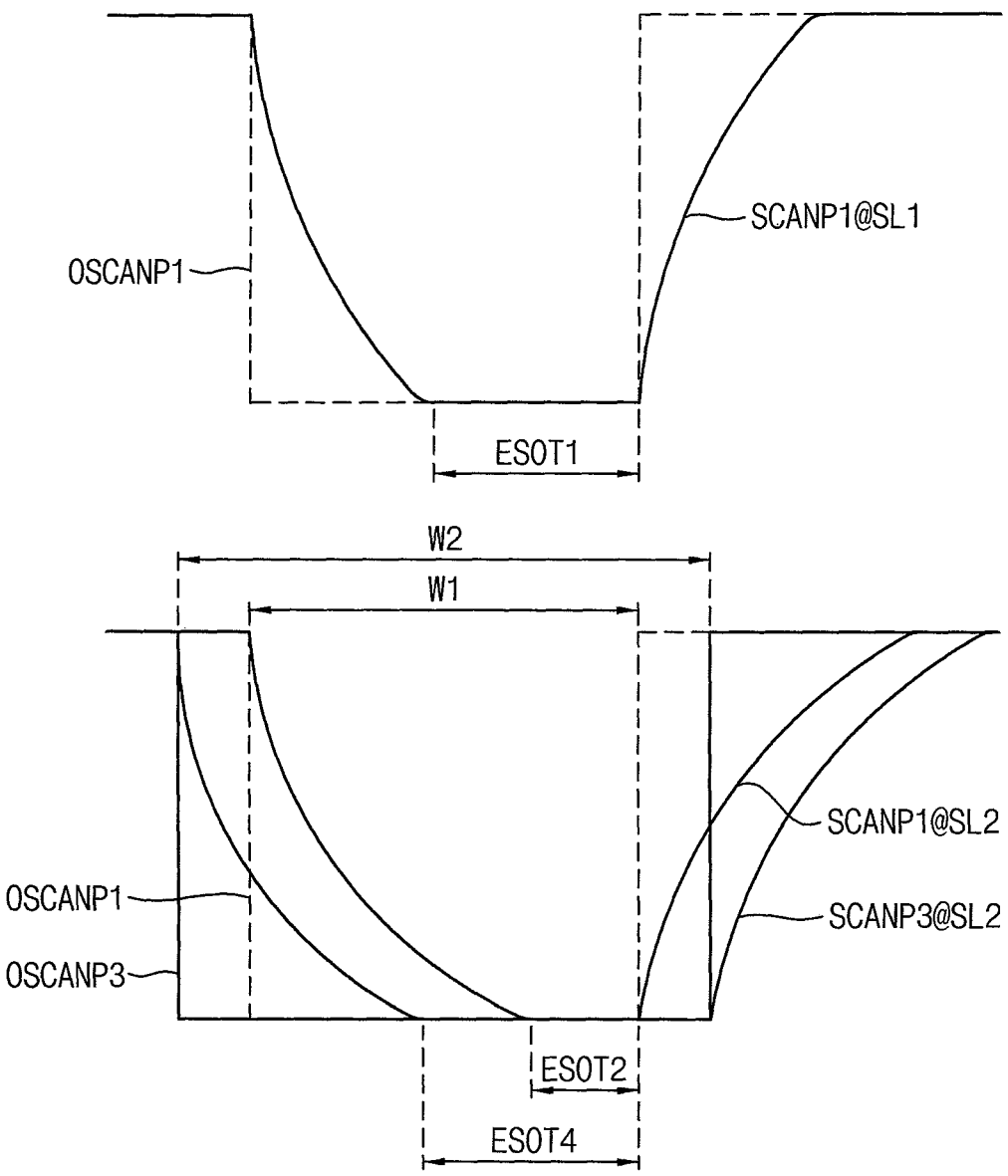
FIG. 13 is a diagram illustrating an example of effective scan on times for first and second pixel rows illustrated in FIG. 6 in an example embodiment where a scan pulse having an adjusted width is applied to the second pixel row.
Figure 14:
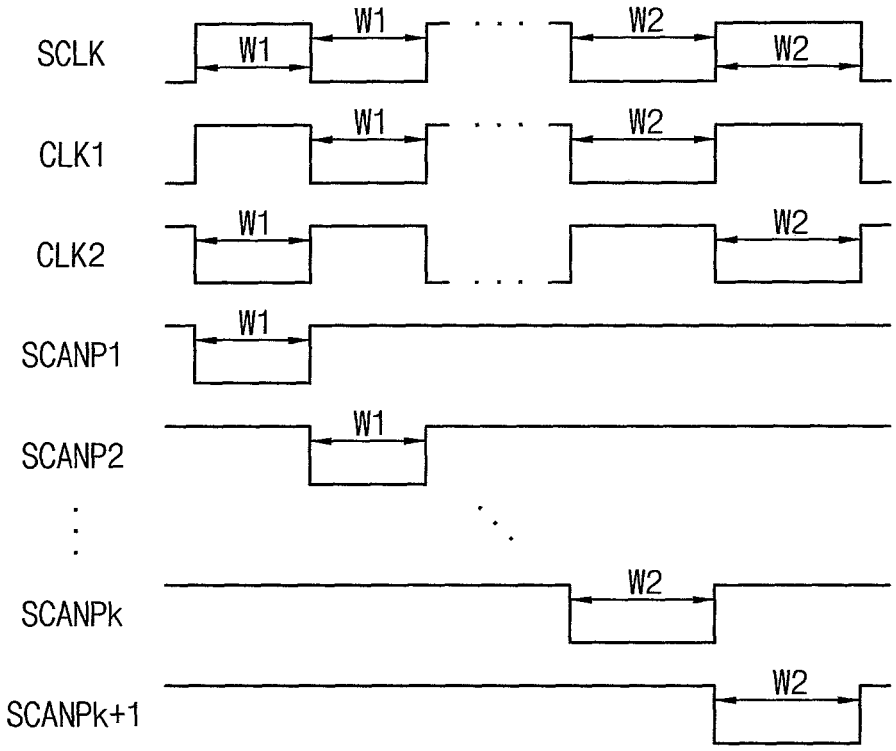
FIG. 14 is a timing diagram for describing an example of an operation of a display device of FIG. 1 to adjust a width of a scan pulse, according to some example embodiments of the present disclosure.

FIG. 1 is a block diagram illustrating a display device according to some example embodiments, FIG. 2 is a circuit diagram illustrating an example of a pixel included in a display device according to some example embodiments, FIG. 3 is a block diagram illustrating an example of a scan driver included in a display device according to some example embodiments, FIG. 4 is a circuit diagram illustrating an example of each stage included in a scan driver of FIG. 3 according to some example embodiments, FIG. 5 is a timing diagram for describing an example of an operation of a scan driver of FIG. 3 according to some example embodiments, FIG. 6 is a diagram for describing an example of loads of first and second scan lines according to first and second line image data for first and second pixel rows in a display device according to some example embodiments, FIG. 7 is a diagram illustrating an example of effective scan on times for first and second pixel rows illustrated in FIG. 6 according to some example embodiments, FIG. 8 is a diagram illustrating examples of histograms of line image data generated by a representative gray value calculation block included in a display device of FIG. 1 according to some example embodiments, FIG. 9 is a diagram illustrating an example of a lookup table included in a display device of FIG. 1 according to some example embodiments, FIG. 10 is a diagram illustrating an example of a scan pulse of which amplitude is adjusted by a scan control block included in a display device of FIG. 1 according to some example embodiments, FIG. 11 is a diagram illustrating an example of effective scan on times for first and second pixel rows illustrated in FIG. 6 in an example where a scan pulse having adjusted amplitude is applied to the second pixel row, FIG. 12 is a diagram illustrating an example of a scan pulse of which a width and timing are adjusted by a scan control block included in a display device of FIG. 1 according to some example embodiments, FIG. 13 is a diagram illustrating an example of effective scan on times for first and second pixel rows illustrated in FIG. 6 in an example embodiment where a scan pulse having an adjusted width is applied to the second pixel row, and FIG. 14 is a timing diagram for describing an example of an operation of a display device of FIG. 1 to adjust a width of a scan pulse according to some example embodiments.

Referring to FIG. 1, a display device 100 according to some example embodiments may include a display panel 110 that includes a plurality of pixel rows, and a panel driver 120 that drives the display panel 110. In some example embodiments, the panel driver 120 may include a data driver 130, a scan voltage generator 140, a scan driver 150 and a controller 160.

The display panel 110 may include the plurality of pixel rows, and each pixel row may include a plurality of pixels PX. In some example embodiments, each pixel row may include the plurality of pixels PX in the same row, or the plurality of pixels PX connected to the same scan line. Each pixel row may be coupled to a plurality of data lines, and the plurality of pixel rows may be respectively connected to a plurality of scan lines. In some example embodiments, the display panel 110 may be an organic light emitting diode (OLED) display panel where each pixel PX may include at least two transistors, at least one capacitor and an OLED.

For example, as illustrated in FIG. 2, each pixel PX may have a 7T1C structure including seven transistors T1, T2, T3, T4, T5, T6, and T7, one capacitor CST and an OLED EL. Each pixel PX may include the first transistor T1 that generates a driving current, the second transistor T2 that transfers a data voltage DV to a source of the first transistor T1 in response to a scan pulse SCANP, the third transistor T3 that diode-connects the first transistor T1 in response to the scan pulse SCANP, a storage capacitor CST that stores the data voltage DV transferred through the second transistor T2 and the diode-connected first transistor T1, the fourth transistor T4 that provides an initialization voltage VINIT to the storage capacitor CST and a gate of the first transistor T1 in response to an initialization signal SI, the fifth transistor T5 that connects a line of a high power supply voltage ELVDD to the source of the first transistor T1 in response to an emission control signal SEM, the sixth transistor T6 that connect a drain of the first transistor T1 to the OLED EL in response to the emission control signal SEM, the seventh transistor T7 that provides the initialization voltage VINIT to the OLED EL in response to the initialization signal SI, and the OLED EL that emits light based on the driving current flowing from the line of the high power supply voltage ELVDD to a line of a low power supply voltage ELVSS. In some example embodiments, the display device 100 may further include an emission driver that applies the emission control signal SEM to the fifth and sixth transistors T5 and T6. Further, according to example embodiments, the scan driver 150 may further generate the initialization signal SI in addition to the scan pulse SCANP, or the scan pulse SCANP for a previous pixel row may be used as the initialization signal SI for a current pixel row.

Although FIG. 2 illustrates an example of the pixel PX having the 7T1C structure, a structure of each pixel PX included in the display device 100 according to some example embodiments may not be limited to the 7T1C structure of FIG. 2. In some other example embodiments, the display panel 110 may be a liquid crystal display (LCD) panel where each pixel PX may include a switching transistor and a liquid crystal capacitor connected to the switching transistor. However, the display panel 110 may not be limited to the OLED display panel and/or the LCD panel.

For example, the display panel 110 may be any suitable type of display panel known to those skilled in the art.

The data driver 130 may generate the data voltages DV based on output line image data OLID and a data control signal DCTRL received from the controller 160, and may provide the data voltages DV to the plurality of pixels PX in each pixel row through the plurality of data lines. Here, each (input/output) line image data ILID and OLID may be image data for a corresponding pixel row, and may include a plurality of pixel image data for the plurality of pixels PX in the corresponding pixel row. For example, the data driver 130 may sequentially receive a plurality of output line image data OLID for the plurality of pixel rows from the controller 160, and may provide the pixel row corresponding to each output line image data OLID with the plurality of data voltages DV respectively corresponding to a plurality of pixel gray values represented by the output line image data OLID. In some example embodiments, the data control signal DCTRL may include, but may not be limited to, an output data enable signal DE, a data clock DCLK and/or a load signal. In some example embodiments, the data driver 130 and the controller 160 may be implemented with a single integrated circuit, and the single integrated circuit may be referred to as a timing controller embedded data driver (TED). In some other example embodiments, the data driver 130 and the controller 160 may be implemented with separate integrated circuits.

The scan voltage generator 140 may generate signals and/or voltages FLM, CLK1, CLK2, VGL, and VGH for the scan driver 150 based on a scan control signal SCTRL received from the controller 160, and the scan driver 150 may sequentially apply the scan pulse SCANP to the plurality of pixel rows based on the signals and/or voltages FLM, CLK1, CLK2, VGL, and VGH received from the scan voltage generator 140. In some example embodiments, the scan control signal SCTRL may include, but may not be limited to, a scan start signal FLM, a scan clock signal SCLK, and/or a voltage level control signal VLCTRL. For example, the scan voltage generator 140 may generate the scan start signal FLM provided to the scan driver 150 based on the scan start signal FLM received from the controller 160, may generate first and second clock signals CLK1 and CLK2 provided to the scan driver 150 based on the scan clock signal SCLK received from the controller 160, and may adjust at least one of a high gate voltage VGH and/or a low gate voltage VGL provided to the scan driver 150 in response to the voltage level control signal VLCTRL received from the controller 160. In some example embodiments, the scan voltage generator 140 may be included in a power management integrated circuit (PMIC) that supplies power to the display device 100, but a location of the scan voltage generator 140 may not be limited to the PMIC. In some example embodiments, the scan driver 150 may be integrated or formed (or located) in a peripheral portion (or region) of the display panel 110. In some other example embodiments, the scan driver 150 may be implemented in the form of an integrated circuit. The scan driver 150 may sequentially apply the scan pulse SCANP to the plurality of pixel rows based on the scan start signal FLM, the first clock signal CLK1, the second clock signal CLK2, the high gate voltage VGH and the low gate voltage VGL received from the scan voltage generator 140.

In some example embodiments, as illustrated in FIG. 3, the scan driver 150 may include a plurality of stages, for example, stage 1 152, stage 2 154, stage 3 156, stage 4 158, etc. that respectively apply a plurality of scan pulses SCANP1, SCANP2, SCANP3, SCANP4, to the plurality of pixel rows based on the scan start signal FLM, the first clock signal CLK1, the second clock signal CLK2, the high gate voltage VGH, and the low gate voltage VGL received from the scan voltage generator 140.

For example, as illustrated in FIG. 4, each stage 152*a* (e.g., stage 1 152, stage 2 154, stage 3 156, stage 4 158, etc.) may include a first transistor M1 which transfers the scan start signal FLM or a previous scan pulse PSS to a first node N1 in response to the first clock signal CLK1 (or the second clock signal CLK2 in case of an even-numbered stage, e.g., stage 2 154 and/or stage 4 158), a second transistor M2 which transfers the high gate voltage VGH to a fourth node N4 in response to a voltage of a third node N3, a third transistor M3 which transfers a voltage of the fourth node N4 to the first node N1 in response to the second clock signal CLK2 (or the first clock signal CLK1 in case of an even-numbered stage, e.g., stage 2 154 and/or stage 4 158), a fourth transistor M4 which transfers the first clock signal CLK1 (or the second clock signal CLK2 in case of the even-numbered stage, e.g., stage 2 154 and/or stage 4 158) to the third node N3 in response to a voltage of the first node N1, a fifth transistor M5 which transfers the low gate voltage VGL to the third node N3 in response to the first clock signal CLK1 (or the second clock signal CLK2 in case of the even-numbered stage, e.g., stage 2 154 and/or stage 4 158), a sixth transistor M6 which outputs the high gate voltage VGH as the scan pulse SCANP1 to a scan output node NS in response to the voltage of the third node N3, a seventh transistor M7 which outputs the second clock signal CLK2 (or the first clock signal CLK1 in case of the even-numbered stage, e.g., stage 2 154 and/or stage 4 158) as the scan pulse SCANP1 to the scan output node NS in response to a voltage of a second node N2, an eighth transistor M8 which transfers the voltage of the first node N1 to the second node N2 in response to the low gate voltage VGL, a first capacitor C1 connected between a line of the high gate voltage VGH and the third node N3, and a second capacitor C2 connected between the second node N2 and the scan output node NS. However, a configuration of each stage, e.g., stage 1 152, stage 2 154, stage 3 156, and/or stage 4158, of the scan driver 150 according to example embodiments of the present disclosure may not be limited to the example embodiment of FIG. 4.

Referring to FIGS. 1, 4, and 5, the scan voltage generator 140 may generate the first clock signal CLK1 and the second clock signal CLK2 based on the scan clock signal SCLK. For example, as illustrated in FIG. 5, the scan voltage generator 140 may generate the first clock signal CLK1 having the same phase as the scan clock signal SCLK, and the second clock signal CLK2 having an opposite phase to the scan clock signal SCLK. However, the phases of the first clock signal CLK1, the second clock signal CLK2, and the scan clock signal SCLK may not be limited to the example embodiment of FIG. 5. As illustrated in FIG. 5, odd-numbered stages, e.g., stage 1 152 and/or stage 3 156, may output the scan pulses SCANP1 and/or SCANP3, that transition from the high gate voltage VGH to the low gate voltage VGL in synchronization with the second clock signal CLK2, and even-numbered stages, e.g., stage 2 154 and/or stage 4 158, may output the scan pulses SCANP2 and/or SCANP4, that transition from the high gate voltage VGH to the low gate voltage VGL in synchronization with the first clock signal CLK1. However, timings of the scan pulses SCANP1, SCANP2, SCANP3, and/or SCANP4, may not be limited to the example embodiment of FIG. 5.

Referring again to FIG. 1, the controller (e.g., a timing controller (TCON)) 160 may receive line image data ILID and a control signal CTRL from an external host processor (e.g., an application processor (AP), a graphic processing unit (GPU), and/or a graphic card). For example, the controller 160 may sequentially receive a plurality of line image data ILID for the plurality of pixel rows. In some example embodiments, the control signal CTRL may include, but may not be limited to, a vertical synchronization signal, a horizontal synchronization signal, an input data enable signal, a master clock signal, etc. The controller 160 may generate the output line image data OLID, the data control signal DCTRL, and the scan control signal SCTRL based on the line image data ILID and the control signal CTRL. The controller 160 may control an operation of the data driver 130 by providing the output line image data OLID and the data control signal DCTRL to the data driver 130, and may control operations of the scan voltage generator 140 and the scan driver 150 by providing the scan control signal SCTRL to the scan voltage generator 140.

In some embodiments, loads of the plurality of scan lines connected to the respective ones of the plurality of pixel rows in the display panel 110 may be varied according to the plurality of line image data ILID for the plurality of pixel rows. For example, as illustrated in FIG. 6, a first scan line SL1 connected to a first pixel row PXR1 may be modeled as a first scan line model SLM1 including a modeled resistor MR and a modeled capacitor MC, and a second scan line SL2 connected to a second pixel row PXR2 may be modeled as a second scan line model SLM2 including the modeled resistor MR and the modeled capacitor MC. Further, in an example case where an image having a high gray value (e.g., a 255-gray value 255G) and a low gray value (e.g., a 0-gray value OG) is displayed in a display panel 110*a*, a plurality of pixel image data included in line image data ILID for the first pixel row PXR1 have pixel gray values corresponding to the high gray value, and at least a portion of a plurality of pixel image data included in line image data ILID for the second pixel row PXR2 have pixel gray values corresponding to the low gray value, a data voltage (e.g., a white data voltage) WDV corresponding to the high gray value may be stored in the pixels PX in the first pixel row PXR1, and a data voltage (e.g., a black data voltage) BDV corresponding to the low gray value may be stored in at least a portion of the pixels PX in the second pixel row PXR2. In the display device 100 including plurality of pixels (e.g., the pixel PX of FIG. 2), the data voltage BDV corresponding to the low gray value may have a voltage level higher than that of the data voltage WDV corresponding to the high gray value. Moreover, compared to the pixels PX storing the data voltage WDV having a relatively low voltage level, the pixels PX storing the data voltage BDV having a relatively high voltage level may serve as a high load with respect to the scan pulse SCANP (e.g., SCANP1, SCANP2, SCANP3, SCANP4) that transitions from the high gate voltage VGH to the low gate voltage VGL (as shown in FIG. 5). Thus, as the pixel gray values represented by the line image data ILID for each pixel row decrease, the load of the scan line connected to the pixel row increases.

As the scan line load corresponding to each pixel row increases, an effective scan on time for the pixel row may be reduced or decreased. For example, as illustrated in FIGS. 6 and 7, in a case where the line image data ILID for the second pixel row PXR2 may represent the pixel gray values lower than those of the line image data ILID for the first pixel row PXR1, the scan line load for the second pixel row PXR2 may be greater than the scan line load for the first pixel row PXR1. Further, in a case where the scan line load for the second pixel row PXR2 is greater than the scan line load for the first pixel row PXR1, even if the scan driver 150 outputs the same output scan pulse OSCANP to the first scan line SL1 and the second scan line SL2, a time point at which the scan pulse SCANP@SL2 at the second scan line SL2 reaches a desired voltage level (e.g., a reference voltage level) may be later than a time point (or later in time) at which the scan pulse SCANP@SL1 at the first scan line SL1 reaches the desired voltage level. Accordingly, the effective scan on time ESOT2 for the second pixel row PXR2 may be shorter than the effective scan on time ESOT1 for the first pixel row PXR1. Therefore, if the scan pulse SCANP applied to each pixel row is not adjusted, the plurality of pixel rows may have different effective scan on times, and thus luminance uniformity of the display device 100 may be deteriorated. As such, concurrent application (e.g., simultaneous application) of the scan pulse SCANP to each pixel row may be desired to achieve uniform luminance in a display (e.g., the display panel 110).

However, in the display device 100 according to some example embodiments, in order to achieve substantially the same effective scan on time for the plurality of pixel rows, the controller 160 may include a scan on time (SOT) decider 200 that receives the line image data ILID for each pixel row, and determines (e.g., decides) a scan on time change amount SOTCA for each pixel row based on the line image data ILID, and a scan control block 280 that adjusts the scan pulse SCANP applied to each pixel row according to (e.g., based on) the scan on time change amount SOTCA.

In some example embodiments, in order to determine the scan on time change amount SOTCA for each pixel row, the SOT decider 200 may include a representative gray value (RGV) calculation block 220 that calculates a representative gray value RGV of the line image data ILID for each pixel rows, and a scan on time change amount (SOTCA) decision block 240 that determines the scan on time change amount SOTCA for each pixel row according to the representative gray value RGV of the line image data ILID.

In some example embodiments, the RGV calculation block 220 may calculate, as the representative gray value RGV of the line image data ILID, an average of a plurality of pixel gray values for the plurality of pixels PX in each pixel row. An average of a plurality of pixel gray values may be represented by (or determined based on) the line image data ILID for each pixel row. In some other example embodiments, the RGV calculation block 220 may calculate the representative gray value RGV based on a histogram of the line image data ILID. For example, as illustrated in FIG. 8, the RGV calculation block 220 may generate histograms 310 and 330 of the line image data ILID by grouping the plurality of pixel gray values represented by the line image data ILID into a plurality of pixel gray groups (e.g., PGG1, PGG2, PGG3, PGG4, PGG5, PGG6, PGG7, and PGG8). The RGV calculation block 220 may determine the representative gray value RGV of the line image data ILID based on the histogram 310 and 330 of the line image data ILID. For example, the representative gray value RGV determined based on the histogram 330 where most of the pixels PX exist in relatively low pixel gray groups (e.g., PGG1, PGG2, and PGG3) may be lower than the representative gray value RGV determined based on the histogram 310 where most of the pixels PX exist in relatively high pixel gray groups (e.g., PGG6, PGG7, and PGG8).

The SOTCA decision block 240 may increase the scan on time change amount SOTCA as the representative gray value RGV of the line image data ILID decreases. For example, the scan on time change amount SOTCA may vary according to (e.g., inversely proportional to) the representative gray value RGV of the line image data ILID. In some example embodiments, the SOT decider 200 may further include a lookup table (LUT) 260 that stores the scan on time change amount SOTCA corresponding to the representative gray value RGV of the line image data ILID. The SOTCA decision block 240 may determine the scan on time change amount SOTCA for each pixel row by reading the scan on time change amount STOCA corresponding to the representative gray value RGV calculated by the RGV calculation block 220 from the LUT 260. In some example embodiments, the LUT 260 may store a plurality of scan on time change amounts SOTCA corresponding to a set of gray values (e.g., from a 0-gray value to a 255-gray value). In some other example embodiments, as illustrated in FIG. 9, the LUT 260*a* may store the scan on time change amounts SOTCA1 through SOTCA8 corresponding to a portion of the entire set of gray values, or reference gray values SOTCA1 through SOTCA8. In such a case, the SOTCA decision block 240 may read two scan on time change amounts corresponding to two reference gray values adjacent (or immediately adjacent) to the representative gray value RGV from the LUT 260*a*, and may determine the scan on time change amount SOTCA corresponding to the representative gray value RGV by linearly interpolating the two scan on time change amounts. For example, the SOTCA decision block 240 may read two scan on time change amounts SOTCA4 and SOTCA6 corresponding to two reference gray values RGV4 and RGV6 adjacent (or immediately adjacent) to the representative gray value RGV5 from the LUT 260*a*, and may determine the scan on time change amount SOTCA5 corresponding to the representative gray value RGV5 by linearly interpolating the two scan on time change amounts SOTCA4 and SOTCA6.

The scan control block 280 may adjust at least one of an amplitude, a width, and a timing of the scan pulse SCANP applied to each pixel row according to the scan on time change amount SOTCA determined by the SOT decider 200.

In some example embodiments, as the scan on time change amount SOTCA increases, the scan control block 280 may increase the amplitude of the scan pulse SCAN P by adjusting at least one of the high gate voltage VGH and the low gate voltage VGL. For example, the scan on time change amount SOTCA is directly proportional to the amplitude of the scan pulse SCANP. For example, as illustrated in FIG. 10, the scan control block 280 may increase a first amplitude AMP1 of the scan pulse SCANP to second amplitude AMP2 by increasing a voltage level of the high gate voltage VGH and/or by decreasing a voltage level of the low gate voltage VGL.

In some example embodiments, to adjust the amplitude of the scan pulse SCANP, the scan control block 280 may output the voltage level control signal VLCTRL representing an adjusted voltage level of the high gate voltage VGH and/or the low gate voltage VGL in response to the scan on time change amount SOTCA. The scan voltage generator 140 may adjust the high gate voltage VGH and/or the low gate voltage VGL to the adjusted voltage level represented by (or based on) the voltage level control signal VLCTRL. In response to receiving the adjusted high gate voltage VGH and/or the low gate voltage VGL, scan driver 150 may output the scan pulse SCANP having an adjusted amplitude (as shown in FIG. 10) based on the adjusted high gate voltage VGH and/or the adjusted low gate voltage VGL.

For example, as illustrated in FIGS. 6 and 11, the scan driver 150 may apply a first output scan pulse OSCANP1 having a first voltage level VGL1 to the first scan line SL1 for the first pixel row PXR1, and the scan pulse SCANP1@SL1 at the first scan line SL1 may have a first effective scan on time ESOT1. In an example case where the representative gray value RGV of the line image data ILID for the second pixel row PXR2 is lower than the representative gray value RGV of the line image data ILID for the first pixel row PXR1, and the first output scan pulse OSCANP1 is applied also to the second pixel row PXR2, the scan pulse SCANP1@SL2 at the second scan line SL2 may have a second effective scan on time ESOT2 shorter than the first effective scan on time ESOT1. However, in the display device 100 according to some example embodiments, in a case where the representative gray value RGV of the line image data ILID for the second pixel row PXR2 is lower than the representative gray value RGV of the line image data ILID for the first pixel row PXR1, the SOT decider 200 may increase the scan on time change amount SOTCA for the second pixel row PXR2. In such a case, the scan control block 280 may output the voltage level control signal VLCTRL to decrease the low gate voltage VGL from the first voltage level VGL1 to a second voltage level VGL2 in response to the increased scan on time change amount SOTCA. In response to receiving the voltage level control signal VLCTRL, the scan voltage generator 140 may output the low gate voltage VGL having the second voltage level VGL2, and the scan driver 150 may apply a second output scan pulse OSCANP2 having the second voltage level VGL2 to the second scan line SL2 for the second pixel row PXR2. In such a case, the scan pulse SCANP2@SL2 at the second scan line SL2 may have a third effective scan on time ESOT3 substantially the same as the first effective scan on time ESOT1. In this manner, the display device 100 according to the example embodiments of the present disclosure may increase the amplitude of the scan pulse SCANP as the representative gray value RGV of the line image data ILID for each pixel row decreases, thereby allowing the plurality of pixel rows to have substantially the same effective scan on time. For example, in order to achieve a substantially same effective scan on time for the plurality of pixel rows, the amplitude of the scan pulse SCANP may be corresponding to the representative gray value RGV of the line image data ILID for each pixel row.

In some other example embodiments, as the scan on time change amount SOTCA increases, the scan control block 280 may increase the width of the scan pulse SCANP, or may advance the timing of the scan pulse SCANP (e.g., a time point at which the scan pulse SCANP start to be applied, or an application start time point). For example, the scan on time change amount SOTCA may vary according to a change in the width of the scan pulse SCANP. For example, as illustrated in FIG. 12, the scan control block 280 may increase a first width W1 of the scan pulse SCANP to a second width W2, or may advance a first application start time point T1 of the scan pulse SCANP to a second application start time point T2.

In some example embodiments, the scan control block 280 may output the scan clock signal SCLK of which a width or a timing is adjusted in response to the scan on time change amount SOTCA, the scan voltage generator 140 may generate the first clock signal CLK1 and the second clock signal CL2 of which widths or timings are adjusted based on the scan clock signal SCLK having the adjusted width or the adjusted timing, and the scan driver 150 may output the scan pulse SCANP having the adjusted width or the adjusted timing based on the first clock signal CLK1 and the second clock signal CLK2 having the adjusted widths or the adjusted timings. For example, as illustrated in FIGS. 13-14, to apply first and second scan pulses SCANP1 and SCANP2 having a first width W1 to first and second scan lines, and to apply k-th and (k+1)-th scan pulses SCANPk and SCANPk+1 having a second width W2 increased from the first width W1 to k-th and (k+1)-th scan lines, the scan control block 280 may output the scan clock signal SCLK having the first width W1 when the first and second scan pulses SCANP1 and SCANP2 are output, and may output the scan clock signal SCLK having the second width W2 increased from the first width W1 when the k-th and (k+1)-th scan pulses SCANPk and SCANPk+1 are output. The scan voltage generator 140 may generate the first and second clock signals CLK1 and CLK2 having the second width W2 based on the scan clock signal SCLK having the second width W2, and the scan driver 150 may output the k-th and (k+1)-th scan pulses SCANPk and SCANPk+1 having the second width W2 based on the first and second clock signals CLK1 and CLK2 having the second width W2.

For example, as illustrated in FIGS. 6 and 13, the scan driver 150 may apply a first output scan pulse OSCANP1 having a first width W1 to the first scan line SL1 for the first pixel row PXR1, and the scan pulse SCANP1@SL1 at the first scan line SL1 may have a first effective scan on time ESOT1. In a case where the representative gray value RGV of the line image data ILID for the second pixel row PXR2 is lower than the representative gray value RGV of the line image data ILID for the first pixel row PXR1, and the first output scan pulse OSCANP1 is applied also to the second pixel row PXR2, the scan pulse SCANP1@SL2 at the second scan line SL2 may have a second effective scan on time ESOT2 shorter than the first effective scan on time ESOT1. However, in the display device 100 according to some example embodiments of the present disclosure, in a case where the representative gray value RGV of the line image data ILID for the second pixel row PXR2 is lower than the representative gray value RGV of the line image data ILID for the first pixel row PXR1, the SOT decider 200 may increase the scan on time change amount SOTCA for the second pixel row PXR2, the scan control block 280 may output the scan clock signal SCLK having a second width W2 increased from the first width W1 in response to the increased scan on time change amount SOTCA, the scan voltage generator 140 may output the first and second clock signals CLK1 and CLK2 having the second width W2 in response to the scan clock signal SCLK, and the scan driver 150 may apply a third output scan pulse OSCANP3 having the second width W2 to the second scan line SL2 for the second pixel row PXR2. In this case, the scan pulse SCANP3@SL2 at the second scan line SL2 may have a fourth effective scan on time ESOT4 substantially the same as the first effective scan on time ESOT1. In this manner, the display device 100 according to the example embodiments of the present disclosure, may increase the width of the scan pulse SCANP as the representative gray value RGV of the line image data ILID for each pixel row decreases, thereby allowing the plurality of pixel rows to have substantially the same effective scan on time.

As described above, the display device 100 according to the example embodiments of the present disclosure may determine the scan on time change amount SOTCA for each pixel row based on the line image data ILID for the pixel row, and may adjust the amplitude, the width and/or the timing of the scan pulse SCANP applied to the pixel row according to the scan on time change amount SOTCA. Accordingly, in the display device 100 according to some example embodiments of the present disclosure, the plurality of pixel rows included in the display panel 110 may have substantially the same effective scan on time, and the luminance uniformity of the display device 100 may be increased.

Figure 15:
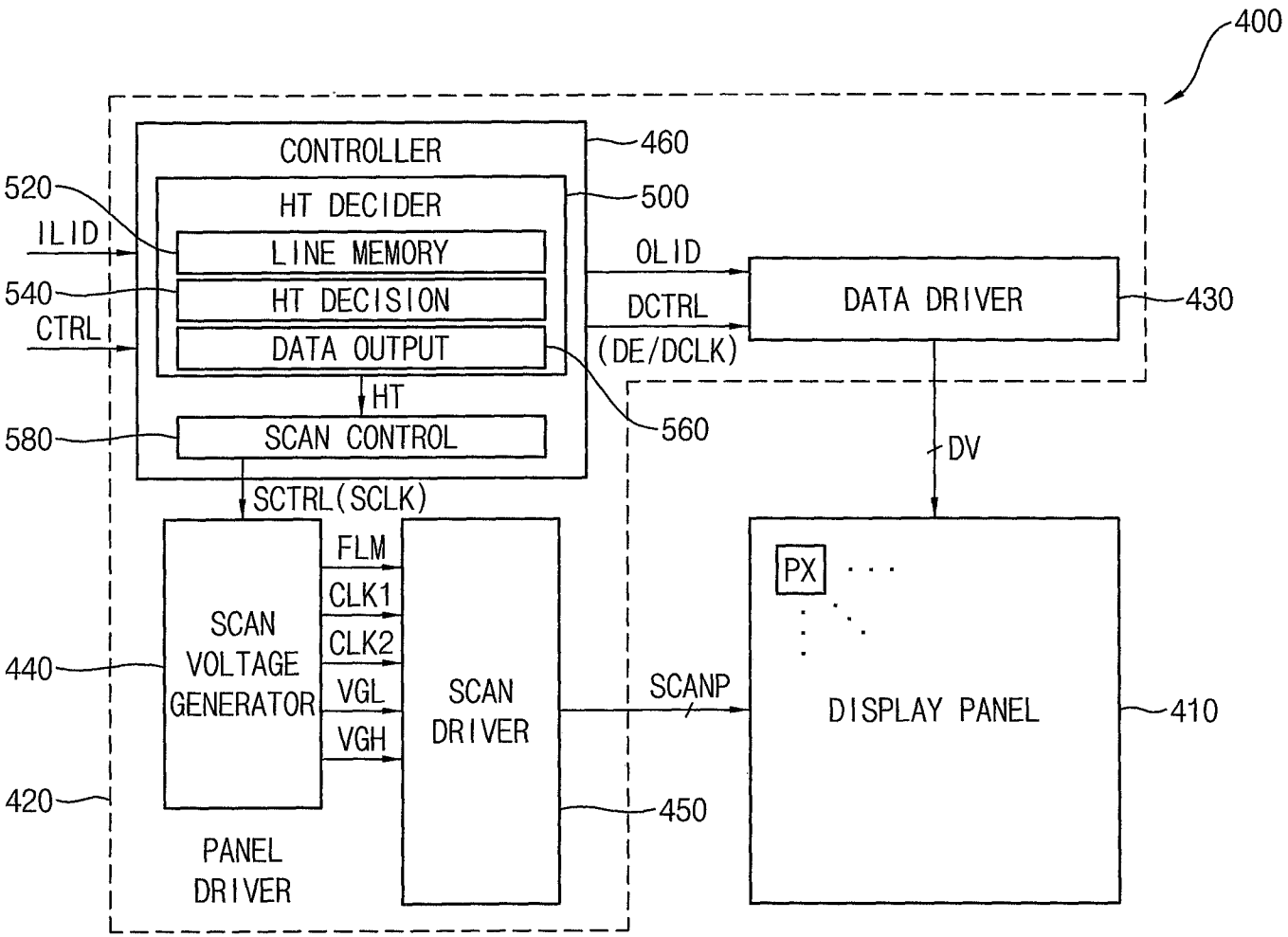
FIG. 15 is a block diagram illustrating a display device, according to some example embodiments of the present disclosure.
Figure 16:
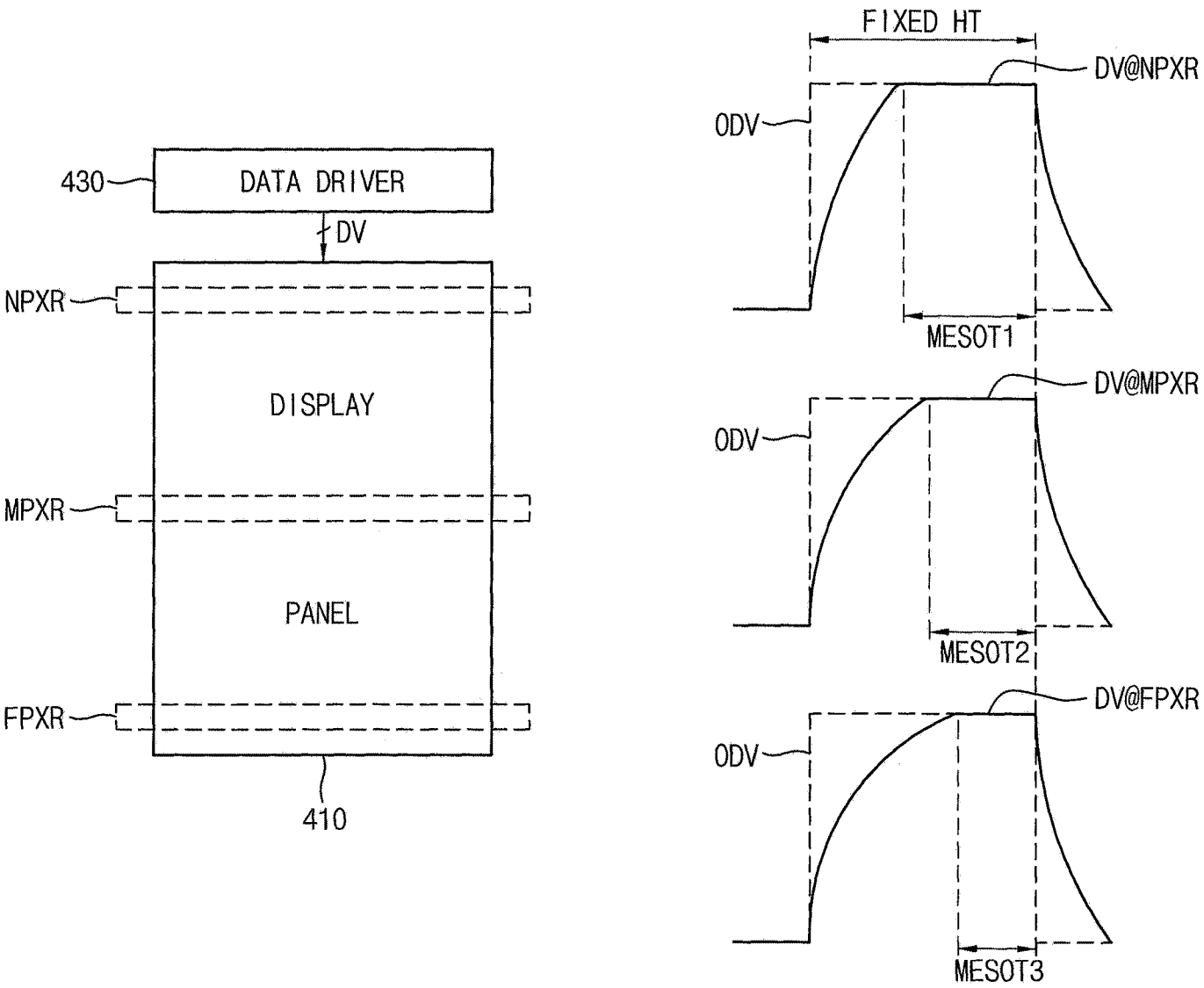
FIG. 16 is a diagram for describing an example of the maximum effective scan on time for each pixel row according to a distance from a data driver to each pixel row in an example embodiment where a horizontal time is fixed.
Figure 17:
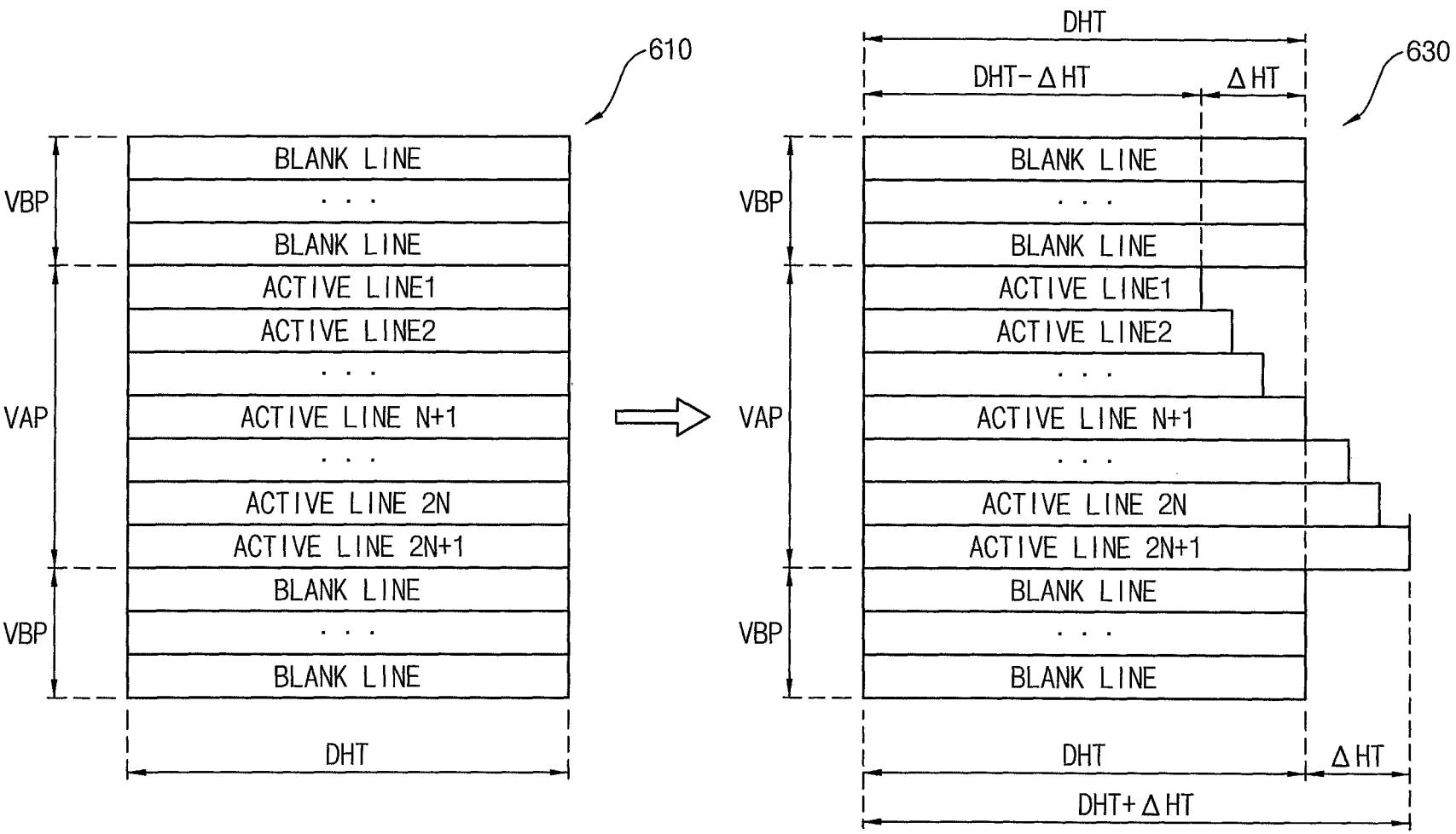
FIG. 17 is a diagram illustrating an example of a frame period having a fixed horizontal time and an example of a frame period where a horizontal time is adjusted, according to some example embodiments of the present disclosure.
Figure 18:
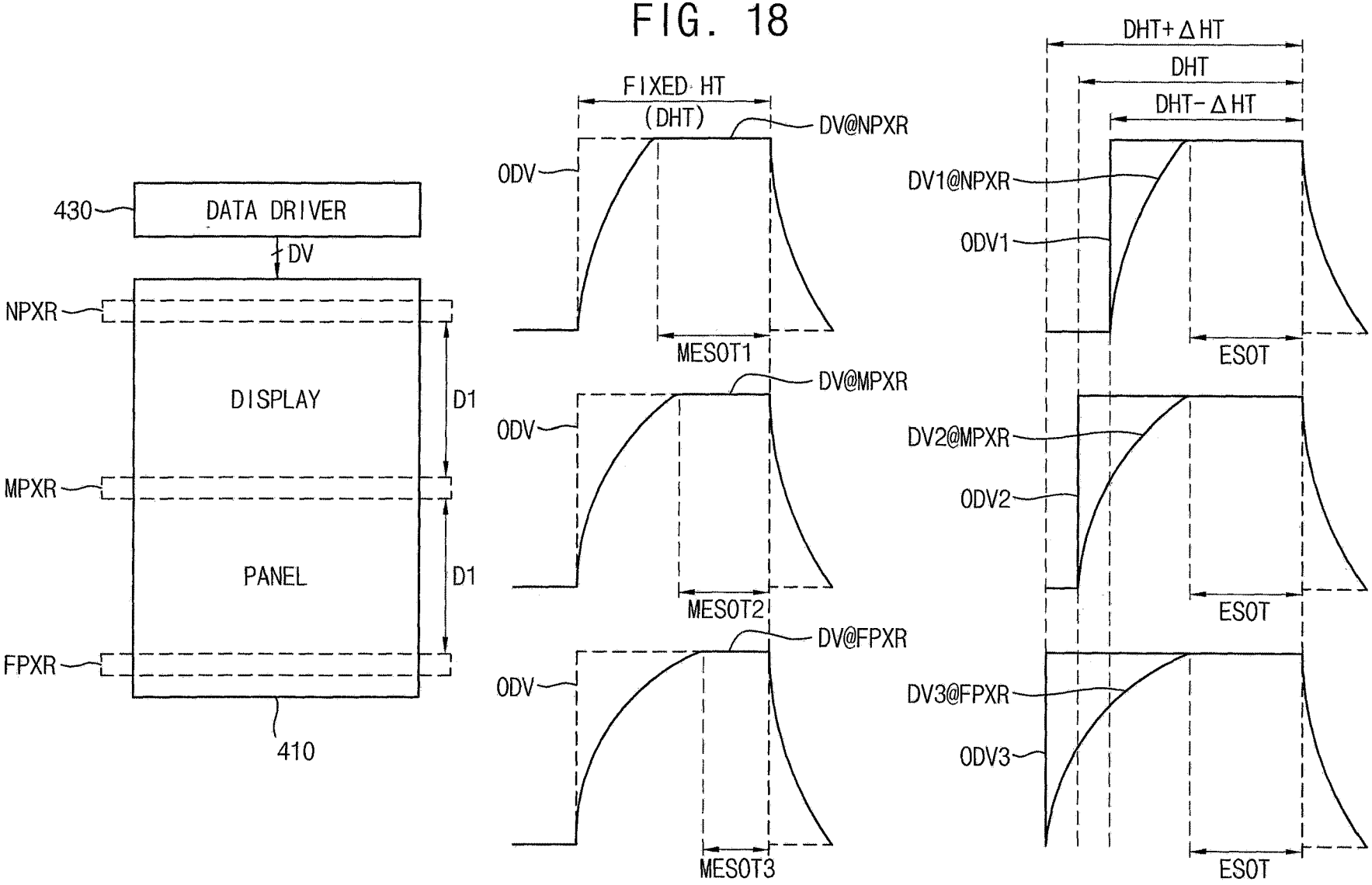
FIG. 18 is a diagram for describing an example of effective scan on times of pixel rows having different distances from a data driver in an example embodiment where a horizontal time is adjusted, according to some example embodiments of the present disclosure.
Figure 19:
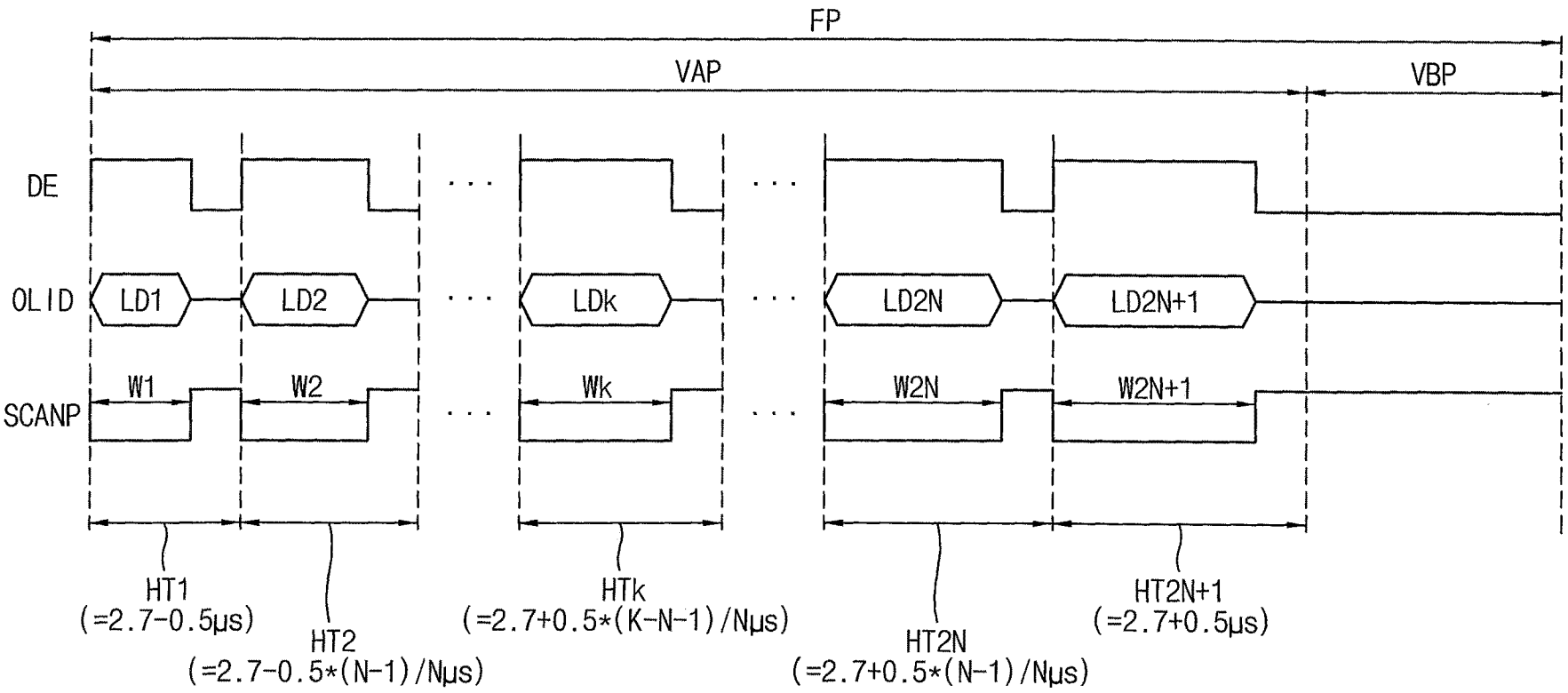
FIG. 19 is a timing diagram for describing an example of an operation of a display device, according to some example embodiments of the present disclosure.

FIG. 15 is a block diagram illustrating a display device, according to some example embodiments of the present disclosure, FIG. 16 is a diagram for describing an example of the maximum effective scan on time for each pixel row according to a distance from a data driver to each pixel row in a case where a horizontal time is fixed, FIG. 17 is a diagram illustrating an example of a frame period having a fixed horizontal time and an example of a frame period where a horizontal time is adjusted, according to some example embodiments of the present disclosure, FIG. 18 is a diagram for describing an example of effective scan on times of pixel rows having different distances from a data driver in a case where a horizontal time is adjusted, according to some example embodiments of the present disclosure, and FIG. 19 is a timing diagram for describing an example of an operation of a display device according to some example embodiments of the present disclosure.

Referring to FIG. 15, a display device 400 according to some example embodiments of the present disclosure may include a display panel 410 that includes a plurality of pixel rows, and a panel driver 420 that drives the display panel 410. In some example embodiments, the panel driver 420 may include a data driver 430, a scan voltage generator 440, a scan driver 450 and a controller 460. The display device 400 of FIG. 15 may have a similar configuration and a similar principle of operation to the display device 100 of FIG. 1, except that the controller 460 may include a horizontal time (HT) decider 500 instead of a SOT decider 200, as illustrated in FIG. 1.

As a distance from the data driver 430 to each pixel row (or a distance of the pixel row from the data driver) increases, a transition time during which a data voltage DV reaches a desired voltage level may be increased by a resistor-capacitor (RC) delay. Thus, as the distance from the data driver 430 to each pixel row increases, an effective scan on time in which the data voltage DV is stored in pixels PX included in the pixel row may be reduced. For example, as illustrated in FIG. 16, in a case where the data driver 430 output a data voltage ODV within a fixed or constant horizontal time HT with respect to a near pixel row NPXR close to the data driver 430, a middle pixel row MPXR having a middle distance from the data driver 430, and a far pixel row FPXR far from the data driver 430, the data voltage DV@NPXR at the near pixel row NPXR may relatively rapidly reach a desired voltage level compared to the data voltage DV@MPXR at the middle pixel row MPXR and/or the data voltage DV@FPXR at the far pixel row FPXR. Therefore, the near pixel row NPXR may have a relatively long first maximum effective scan on time MESOT1. Further, the data voltage DV@MPXR at the middle pixel row MPXR may reach the desired voltage level later than the data voltage DV@NPXR at the near pixel row NPXR, and thus the middle pixel row MPXR may have a second maximum effective scan on time MESOT2 shorter than the first maximum effective scan on time MESOT1. Further, the data voltage DV@FPXR at the far pixel row FPXR may reach the desired voltage level later than the data voltage DV@MPXR at the middle pixel row MPXR and/or the data voltage DV@NPXR at the near pixel row NPXR. Therefore, the far pixel row FPXR may have a third maximum effective scan on time MESOT3 that is shorter than the second maximum effective scan on time MESOT2 and/or the first maximum effective scan on time MESOT1. Thus, in a conventional display device having the fixed horizontal time HT, in order to achieve a substantially the same scan on time in a plurality of pixel rows including the near pixel row NPXR, the middle pixel row MPXR and the far pixel row FPXR, a scan pulse SCANP having the scan on time corresponding to the shortest third maximum effective scan on time MESOT3 may be used. However, as a resolution of the display device increases, or as the number of pixel rows increases, the scan on time corresponding to the shortest third maximum effective scan on time MESOT3 may not be sufficient for each pixel PX to store the data voltage DV.

In order to ensure that each pixel PX has a sufficient scan on time, the display device 400 may change a horizontal time HT for each pixel row, and may adjust the scan pulse SCANP for the pixel row corresponding to the changed horizontal time HT. To perform these operations, the controller 460 may include the HT decider 500 that determines the horizontal time HT for each pixel row according to the distance from the data driver 430 to each pixel row, and a scan control block 580 that adjusts the scan pulse SCANP applied to each pixel row according to the determined horizontal time HT.

In some example embodiments, wherein the HT decider 500 may gradually increase the horizontal time HT for each pixel row as the distance from the data driver 430 to each pixel row increases. For example, as illustrated in FIG. 17, a conventional frame period 610 may include a vertical blank period VBP and a vertical active period VAP. The vertical blank period VBP may have a plurality of horizontal times DHT for a plurality of blank lines. The vertical active period VAP may have a plurality of horizontal times DHT for a plurality of active lines, or for the plurality of pixel rows included in the display panel 410. For example, in a case where the display panel 410 includes 2N+1 pixel rows, where N is an integer greater than 0, the vertical active period VAP may have a time length of (2N+1)*(1 horizontal time (i.e., 1H)). Further, in the conventional frame period 610, the horizontal time DHT for each blank line and the horizontal time DHT for each active line may be the same reference (e.g., default, set, or predetermined) horizontal time DHT. However, in a frame period 630 of the display device 400 according to example embodiments, a horizontal time HT for a first active line, or for a first pixel row closet to the data driver 430 may be a time DHT−ΔHT corresponding to a horizontal time change amount ΔHT subtracted from the reference horizontal time DHT, and, as the distance from the data driver 430 to each pixel row (or each active line) increases, the horizontal time HT for the pixel row (or the active line) may be gradually increased. For example, the horizontal time HT for a pixel row (or the active line) may vary according to the distance of the pixel row from the data driver 430. The horizontal time HT for an (N+1)-th active line, or for a middle pixel row having a middle distance from the data driver 430 may be the reference horizontal time DHT that is the horizontal time DHT in the conventional frame period 610. For example, a middle pixel row may be a pixel row which is located substantially in the middle of the display panel 410. Further, the horizontal time HT for an (2N+1)-th active line, or for a last pixel row farthest from the data driver 430 may be a time DHT+ΔHT corresponding to the horizontal time change amount ΔHT added to the reference horizontal time DHT. As described above, in the frame period 630 of the display device 400 according to some example embodiments, the horizontal time HT for the (N+1)-th active line, or the middle pixel row may be the reference horizontal time DHT, the horizontal time HT for each active line, or for each pixel row may be increased or decreased as the distance from the data driver 430 increases or decreases, and thus a time length of the vertical active period VAP of the frame period 630 may be substantially the same as the time length of the vertical active period VAP of the conventional frame period 610.

For example, as illustrated in FIG. 18, the HT decider 500 may determine the horizontal time HT for the middle pixel row MPXR among the plurality of pixel rows included in the display panel 410 as the reference horizontal time DHT. Further the HT decider 500 may determine the horizontal time HT for the near pixel row NPXR spaced by a first interval D1 (or a first distance) apart from the middle pixel row MPXR in a first direction toward the data driver 430 among the plurality of pixel rows as the time DHT−ΔHT corresponding to the horizontal time change amount ΔHT subtracted from the reference horizontal time DHT. Moreover, the HT decider 500 may determine the horizontal time HT for the far pixel row FPXR spaced by the first interval D1 (or the first distance) apart from the middle pixel row MPXR (or a second distance D2 equal to 2D1 apart from the near pixel row NPXR) in a second direction opposite to the first direction among the plurality of pixel rows as the time DHT+ΔHT corresponding to the horizontal time change amount ΔHT added to the reference horizontal time DHT. Accordingly, the data driver 430 may output a first output data voltage ODV1 to the near pixel row NPXR within the time DHT−ΔHT corresponding to the horizontal time change amount ΔHT subtracted from the reference horizontal time DHT. Further, the data driver 430 may output a second output data voltage ODV2 to the middle pixel row MPXR within the reference horizontal time DHT, and also may output a third output data voltage ODV3 to the far pixel row FPXR within the time DHT+ΔHT corresponding to the horizontal time change amount ΔHT added to the reference horizontal time DHT. Although, the first output data voltage ODV1 is applied to the near pixel row NPXR for the relatively short time DHT−ΔHT, a transition time during which the first output data voltage ODV1 reaches the desired voltage level may be relatively short compared to the transition time during which the second output data voltage ODV2 or the third output data voltage ODV3 reach the desired voltage level. Further, although the third output data voltage ODV3 is applied to the far pixel row FPXR for the relatively long time DHT+ΔHT compared to the first output data voltage ODV1 or the second output data voltage ODV2, a transition time during which the third output data voltage ODV3 reaches the desired voltage level may be relatively long compared to the transition time during which the first output data voltage ODV1 or the second output data voltage ODV2 reach the desired voltage level. Accordingly, the data voltage DV1@NPXR at the near pixel row NPXR, the data voltage DV2@MPXR at the middle pixel row MPXR and the data voltage DV3@FPXR at the far pixel row FPXR may have the desired voltage level for substantially the same time ESOT, and thus the near pixel row NPXR, the middle pixel row MPXR, and the far pixel row FPXR may have substantially the same effective scan on time ESOT.

In some example embodiments, the HT decider 500 may include a line memory 520 that stores line image data ILID for each pixel row, a horizontal time (HT) decision block 540 that determines the horizontal time HT for each pixel row according to the distance from the data driver 430 to each pixel row, and a data output block 560 that outputs the line image data OLID stored in the line memory 520 within the determined horizontal time HT. Further, the data output block 560 may provide the data driver 430 with a data enable signal DE representing that the line image data OLID are output, and may increase a width of an active period of the data enable signal DE as the determined horizontal time HT increases. The data output block 560 may further provide the data driver 430 with a data clock signal DCLK, and may increase a period or a cycle of the data clock signal DCLK as the determined horizontal time HT increases. Further, the scan control block 580 may receive the determined horizontal time HT from the HT decision block 540, and may increase a width of the scan pulse SCANP as the determined horizontal time HT increases. For example, the width of the scan pulse SCANP may vary according to the corresponding horizontal time HT.

For example, as illustrated in FIG. 19, each frame period FP may include a vertical active period VAP and a vertical blank period VBP. In a case where the display panel 410 includes first through (2N+1)-th pixel rows, the HT decision block 540 may set the horizontal time HT for an (N+1)-th pixel row as a reference horizontal time (e.g., about 2.7 μs), may set a first horizontal time HT1 for the first pixel row closest the data driver 430 as a time (e.g., about 2.2 μs) corresponding to a horizontal time change amount (e.g., about 0.5 μs) subtracted from the reference horizontal time HT, and may set a (2N+1)-th horizontal time HT2N+1 for the (2N+1)-th pixel row farthest the data driver 430 as a time (e.g., about 3.2 μs) corresponding to the horizontal time change amount added to the reference horizontal time HT. Further, as the distance from the data driver 430 increases, the HT decision block 540 may gradually increase the horizontal time HT for each pixel row according to the distance of the pixel row from the data driver 430. For example, the HT decision block 540 may determine a k-th horizontal time HTk for a k-th pixel row by using an equation, e.g., "(DHT+ΔHT*(k−N−1)/N)", where DHT represents the reference horizontal time HT, and ΔHT represents the horizontal time change amount. In an example of FIG. 19, the k-th horizontal time HTk for the k-th pixel row may be about "((2.7+0.5*(k−N−1))/N)μs". Based on the horizontal time HT determined as described above, the data output block 560 may output first line image data LD1 for the first pixel row and the data enable signal DE within the first horizontal time HT1 of about 2.2 μs, and the scan driver 450 may output the scan pulse SCANP having a first width W1 to the first pixel row. Further, the data output block 560 may output second line image data LD2 for a second pixel row and the data enable signal DE within a second horizontal time HT2 of about "(2.7−0.5*(N−1)/N)μs", and the scan driver 450 may output the scan pulse SCANP having a second width W2 wider than the first width W1 to the second pixel row. Further, the data output block 560 may output k-th line image data LDk for the k-th pixel row and the data enable signal DE within the k-th horizontal time HTk of about "(2.7+0.5*(k−N−1)/N)μs", and the scan driver 450 may output the scan pulse SCANP having a k-th width Wk to the k-th pixel row. Further, the data output block 560 may output 2N-th line image data LD2N for a 2N-th pixel row and the data enable signal DE within a 2N-th horizontal time HT2N of about "(2.7+0.5*(N−1)/N)μs", and the scan driver 450 may output the scan pulse SCANP having a 2N-th width W2N to the 2N-th pixel row. Further, the data output block 560 may output (2N+1)-th line image data LD2N+1 for the (2N+1)-th pixel row and the data enable signal DE within the (2N+1)-th horizontal time HT2N+1 of about 3.2 μs, and the scan driver 450 may output the scan pulse SCANP having a (2N+1)-th width W2N+1 to the (2N+1)-th pixel row. Accordingly, the first through (2N+1)-th pixel rows may have substantially the same effective scan on time. Further, in a case where the display panel 410 includes first through 2N-th pixel rows, the HT decision block 540 may set the horizontal time HT for an N-th pixel row and/or an (N+1)-th pixel row as the reference horizontal time, may set the shortest horizontal time HT for the first pixel row, and may set the longest horizontal time HT for the 2N-th pixel row.

As described above, the display device 400 according to some example embodiments of the present disclosure may determine the horizontal time HT for each pixel row according to the distance from the data driver 430 to the pixel row, and may adjust the width of the scan pulse SCANP applied to the pixel row according to the horizontal time HT. Accordingly, in the display device 400 according to some example embodiments, the plurality of pixel rows included in the display panel 410 may have substantially the same effective scan on time, and the luminance uniformity of the display device 400 may be increased.

Figure 20:
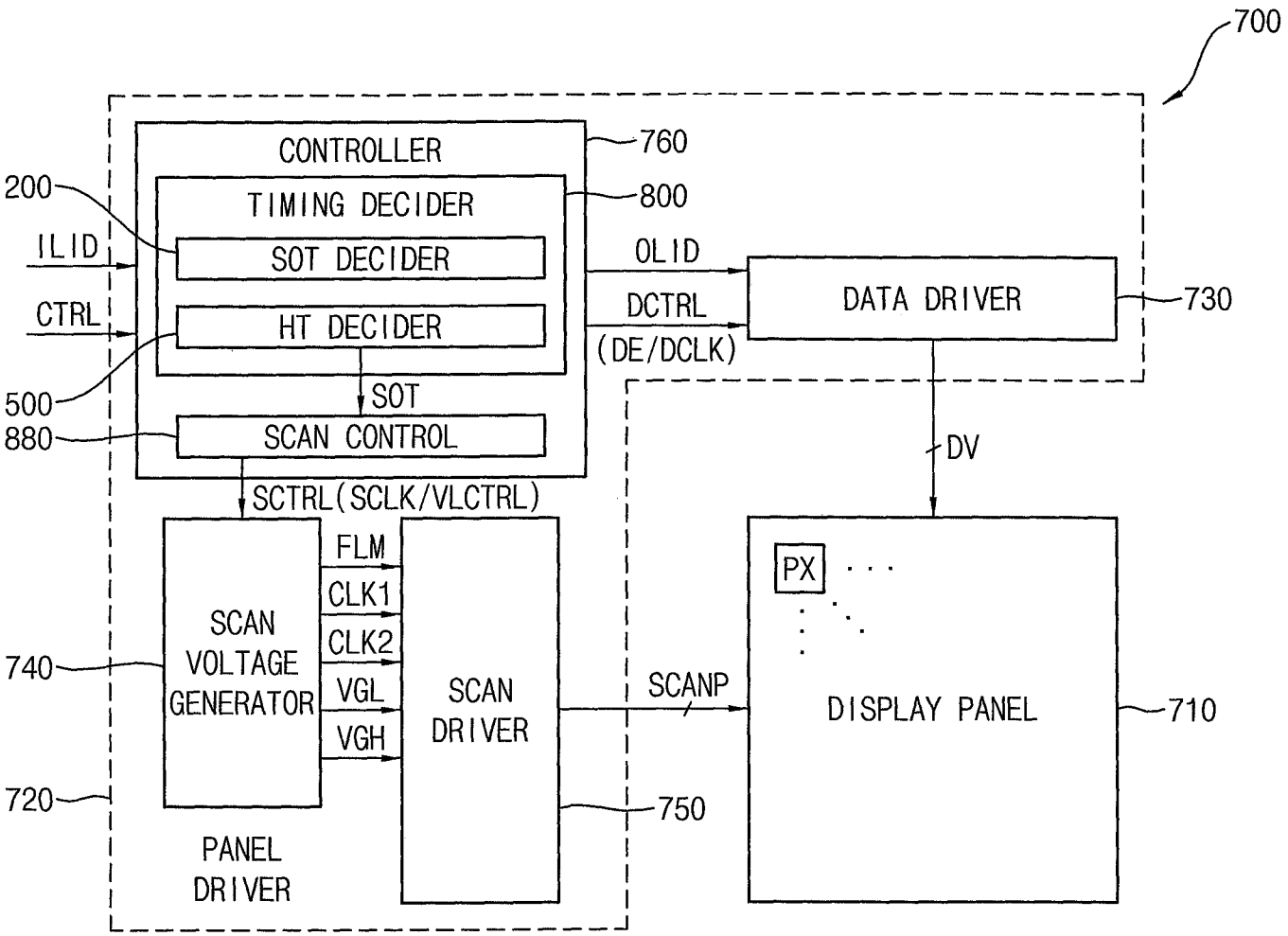
FIG. 20 is a block diagram illustrating a display device, according to some example embodiments of the present disclosure.

FIG. 20 is a block diagram illustrating a display device according to example embodiments.

Referring to FIG. 20, a display device 700 according to some example embodiments of the present disclosure and may include a display panel 710 that includes a plurality of pixel rows, and a panel driver 720 that drives the display panel 710. In some example embodiments, the panel driver 720 may include a data driver 730, a scan voltage generator 740, a scan driver 750 and a controller 760. The display device 700 of FIG. 20 may have a similar configuration and a similar operation to the display device 100 of FIG. 1 or the display device 400 of FIG. 15, except that the controller 760 may include a timing decider 800.

The timing decider 800 may determine a scan on time SOT for each pixel row based on at least one of line image data ILID for each pixel row and a distance from the data driver 730 to each pixel row (or a distance of the pixel row from the data driver). A scan control block 880 may adjust a scan pulse SCANP applied to each pixel row according to the determined scan on time SOT.

In some example embodiments, the timing decider 800 may include a SOT decider 200 (as illustrated in FIG. 1), which determines a scan on time change amount added to a reference scan on time to determine the scan on time SOT. The SOT decider 200 may determine the scan on time change amount for each pixel row according to a representative gray value of the line image data ILID for each pixel row. The scan control block 880 may adjust amplitude, a width and/or a timing of the scan pulse SCANP applied to each pixel row based on the scan on time SOT for each pixel row. For example, the scan control block 880 may adjust amplitude, a width and/or a timing of the scan pulse SCANP applied to a pixel row according to the scan on time SOT for that particular pixel row.

In other example embodiments, the timing decider 800 may include a HT decider 500 (as illustrated in FIG. 15), which determines a horizontal time for each pixel row, and also determines the scan on time SOT according to the determined horizontal time HT. The HT decider 500 may determine the horizontal time for each pixel row according to the distance from the data driver 730 to each pixel row. The HT decider 500 may output the line image data OLID, a data enable signal DE and a data clock signal DCLK based on the determined horizontal time HT, and the scan control block 880 may adjust the amplitude, the width and/or the timing of the scan pulse SCANP for each pixel row based on the scan on time SOT for each pixel row.

In still other example embodiments, the timing decider 800 may include a HT decider 500 that determines a horizontal time for each pixel row according to the distance from the data driver 730 to each pixel row, and determines an intermediate scan on time according to the determined horizontal time, and a SOT decider 200 that determines a scan on time change amount for each pixel row according to a representative gray value of the line image data ILID for each pixel row, and determines the scan on time SOT by adding the scan on time change amount to the intermediate scan on time. The HT decider 500 may output the line image data OLID, the data enable signal DE and the data clock signal DCLK based on the determined horizontal time, and the scan control block 880 may adjust the amplitude, the width and/or the timing of the scan pulse SCANP for each pixel row based on the scan on time SOT for each pixel row.

Figure 21:
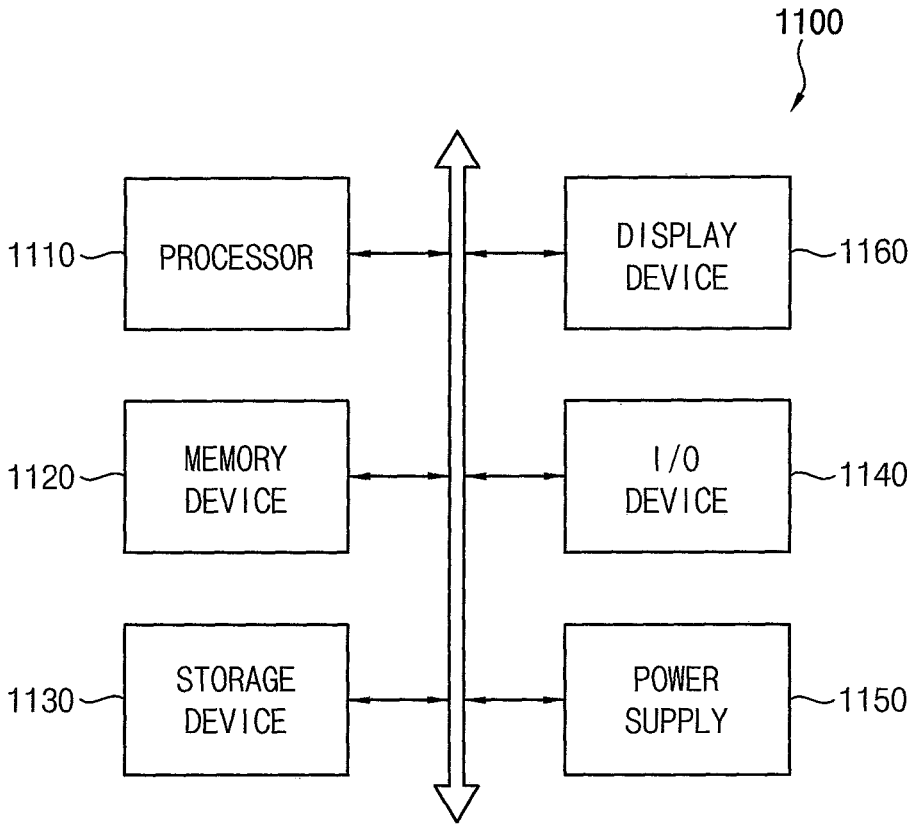
FIG. 21 is a block diagram illustrating an electronic device including a display device, according to some example embodiments of the present disclosure.

FIG. 21 is a block diagram illustrating an electronic device including a display device according to example embodiments.

Referring to FIG. 21, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In some example embodiments, the display device 1160 may determine a scan on time change amount for each pixel row based on line image data for the pixel row, and may adjust a scan pulse applied to the pixel row according to the scan on time change amount. In other example embodiments, the display device 1160 may determine a horizontal time for each pixel row according to a distance from a data driver to the pixel row, and may adjust a scan pulse applied to the pixel row according to the horizontal time. Accordingly, in the display device 1160, a plurality of pixel rows included in a display panel may have substantially the same effective scan on time, and luminance uniformity of the display device 1160 may be increased.

The inventive concepts may be applied to any display device 1160, and any electronic device 1100 including the display device 1160. For example, the inventive concepts may be applied to a mobile phone, a smart phone, a tablet computer, a wearable electronic device, a virtual reality (VR) device, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel comprising a plurality of pixel rows; and a panel driver configured to drive the display panel, the panel driver comprising:

a scan on time decider configured to receive line image data for each of the plurality of pixel rows, and to determine a scan on time change amount for each of the plurality of pixel rows based on the line image data; and a scan control block configured to adjust a scan pulse applied to each of the plurality of pixel rows according to the scan on time change amount and to output a scan clock signal, a width of the scan clock signal being adjusted in response to the scan on time change amount, wherein the scan on time change amount is inversely related to a representative gray value of the line image data.

2. The display device of claim 1, wherein the scan on time decider comprises:

a representative gray value calculation block configured to calculate the representative gray value of the line image data for each of the plurality of pixel rows; and a scan on time change amount decision block configured to determine the scan on time change amount for each of the plurality of pixel rows according to the representative gray value of the line image data.

3. The display device of claim 2, wherein the representative gray value calculation block is configured to calculate the representative gray value of the line image data by determining an average of a plurality of pixel gray values represented by the line image data.

4. The display device of claim 2, wherein the representative gray value calculation block is configured to generate a histogram of the line image data by grouping a plurality of pixel gray values represented by the line image data into a plurality of pixel gray groups, and to determine the representative gray value of the line image data based on the histogram of the line image data.

5. The display device of claim 2, wherein the scan on time change amount decision block is configured to increase the scan on time change amount as the representative gray value of the line image data decreases.

6. The display device of claim 2, wherein the scan on time decider further comprises:

a lookup table configured to store the scan on time change amount corresponding to the representative gray value of the line image data, wherein the scan on time change amount decision block is configured to determine the scan on time change amount for each of the plurality of pixel rows by reading the scan on time change amount corresponding to the representative gray value calculated by the representative gray value calculation block from the lookup table.

7. The display device of claim 1, wherein, based on an increase of the scan on time change amount, the scan control block is further configured to increase an amplitude of the scan pulse by adjusting at least one of a first gate voltage or a second gate voltage lower than the first gate voltage.

8. The display device of claim 7, wherein the panel driver further comprises:

a scan voltage generator configured to generate the first gate voltage and the second gate voltage; and a scan driver configured to apply the scan pulse to each of the plurality of pixel rows based on the first gate voltage and the second gate voltage received from the scan voltage generator, wherein the scan control block is further configured to output a voltage level control signal representing an adjusted voltage level of the first gate voltage or the second gate voltage in response to the scan on time change amount, wherein the scan voltage generator is further configured to adjust the first gate voltage or the second gate voltage to the adjusted voltage level represented by the voltage level control signal, and wherein the scan driver outputs the scan pulse having the adjusted amplitude based on the first gate voltage or the second gate voltage having the adjusted voltage level.

9. The display device of claim 1, wherein, based on an increase of the scan on time change amount, the scan control block is further configured to increase a width of the scan pulse, or to advance a timing of the scan pulse.

10. The display device of claim 9, wherein the panel driver further comprises:

a scan voltage generator configured to generate a first clock signal and a second clock signal based on the scan clock signal; and a scan driver configured to apply the scan pulse to each of the plurality of pixel rows based on the first clock signal and the second clock signal received from the scan voltage generator, wherein the scan voltage generator is further configured to generate the first clock signal and the second clock signal, widths or timings of the first clock signal and the second clock signal being adjusted based on the scan clock signal having the adjusted width or the adjusted timing, and wherein the scan driver is configured to output the scan pulse having the adjusted width or the adjusted timing based on the first clock signal and the second clock signal having the adjusted widths or the adjusted timings.

11. A display device comprising:

a display panel comprising a plurality of pixel rows; and a panel driver configured to drive the display panel, the panel driver comprising:

a data driver configured to provide data voltages to each of the plurality of pixel rows;

a horizontal time decider configured to determine a horizontal time for each of the plurality of pixel rows according to a distance from the data driver to each of the plurality of pixel rows; and a scan control block configured to adjust a scan pulse applied to each of the plurality of pixel rows according to the determined horizontal time and to output a scan clock signal, a width of the scan clock signal being adjusted in response to a scan on time change amount for each of the plurality of pixel rows.

12. The display device of claim 11, wherein the horizontal time decider is further configured to gradually increase the horizontal time for each of the plurality of pixel rows according to the distance from the data driver to each of the plurality of pixel rows.

13. The display device of claim 11, wherein the horizontal time decider is further configured to determine the horizontal time for a middle pixel row from among the plurality of pixel rows as a reference horizontal time, to determine the horizontal time for a near pixel row spaced by a first interval apart from the middle pixel row in a first direction toward the data driver from among the plurality of pixel rows as a horizontal time change amount subtracted from the reference horizontal time, and to determine the horizontal time for a far pixel row spaced by the first interval apart from the middle pixel row in a second direction opposite to the first direction from among the plurality of pixel rows as the horizontal time change amount added to the reference horizontal time.

14. The display device of claim 11, wherein the horizontal time decider comprises:

a line memory configured to store line image data for each of the plurality of pixel rows;

a horizontal time decision block configured to determine the horizontal time for each of the plurality of pixel rows according to the distance from the data driver to each of the plurality of pixel rows; and a data output block configured to output the line image data stored in the line memory within the determined horizontal time.

15. The display device of claim 14, wherein the data output block is further configured to generate a data enable signal in response to the line image data being outputted from the data driver, and to increase a width of an active period of the data enable signal corresponding to an increase of the determined horizontal time.

16. The display device of claim 14, wherein the scan control block is further configured to increase a width of the scan pulse corresponding to an increase of the determined horizontal time.

17. A display device comprising:

a display panel comprising a plurality of pixel rows; and a panel driver configured to drive the display panel, the panel driver comprising:

a timing decider configured to determine a scan on time for each of the plurality of pixel rows based on at least one of line image data for each of the plurality of pixel rows and a distance from a data driver to each of the plurality of pixel rows; and a scan control block configured to adjust a scan pulse applied to each of the plurality of pixel rows according to the determined scan on time and to output a scan clock signal, a width of the scan clock signal being adjusted in response to a scan on time change amount for each of the plurality of pixel rows.

18. The display device of claim 17, wherein the timing decider comprises:

a scan on time decider configured to determine the scan on time change amount, and to determine the scan on time by adding the scan on time change amount to a reference scan on time, and wherein the scan on time decider is configured to determine the scan on time change amount for each of the plurality of pixel rows according to a representative gray value of the line image data for each of the plurality of pixel rows.

19. The display device of claim 17, wherein the timing decider comprises:

a horizontal time decider configured to determine a horizontal time for each of the plurality of pixel rows, and to determine the scan on time according to the determined horizontal time, wherein the horizontal time decider is configured to determine the horizontal time for each of the plurality of pixel rows according to the distance from the data driver to each of the plurality of pixel rows.

20. The display device of claim 17, wherein the timing decider comprises:

a horizontal time decider configured to determine a horizontal time for each of the plurality of pixel rows according to the distance from the data driver to each of the plurality of pixel rows, and to determine an intermediate scan on time according to the determined horizontal time; and a scan on time decider configured to determine the scan on time change amount for each of the plurality of pixel rows according to a representative gray value of the line image data for each of the plurality of pixel rows, and to determine the scan on time by adding the scan on time change amount to the intermediate scan on time.

* * * * *